US010844535B2

(12) United States Patent
Date et al.

(10) Patent No.: US 10,844,535 B2
(45) Date of Patent: Nov. 24, 2020

(54) STEAM IRON WITH A COLLECTION COMPARTMENT FOR CALCIFIED DEPOSITS

(71) Applicant: KONINKLIJKE PHILIPS N.V., Eindhoven (NL)

(72) Inventors: Milind Vishwas Date, Eindhoven (NL); Ruben Arnold Herman Reekers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 106 days.

(21) Appl. No.: 16/094,731

(22) PCT Filed: Apr. 24, 2017

(86) PCT No.: PCT/EP2017/059585
§ 371 (c)(1),
(2) Date: Oct. 18, 2018

(87) PCT Pub. No.: WO2017/186607
PCT Pub. Date: Nov. 2, 2017

(65) Prior Publication Data

US 2019/0186071 A1 Jun. 20, 2019

(30) Foreign Application Priority Data

Apr. 26, 2016 (EP) ..... 16166976
Mar. 21, 2017 (EP) ..... 17162010

(51) Int. Cl.
*D06F 75/14* (2006.01)
*D06F 75/36* (2006.01)

(52) U.S. Cl.
CPC ..... *D06F 75/14* (2013.01); *D06F 75/36* (2013.01)

(58) Field of Classification Search
CPC ..... D06F 75/00; D06F 75/14; D06F 75/20; D06F 75/36; D06F 75/10; D06F 75/16;
(Continued)

(56) References Cited

U.S. PATENT DOCUMENTS 4,854,059 A * 8/1989 Ronchi ..... D06F 75/12 38/93
5,345,704 A 9/1994 Guillot et al.
(Continued)

FOREIGN PATENT DOCUMENTS

EP 0711862 A1 5/1996
EP 2584089 A1 4/2013
(Continued)

*Primary Examiner* — Ismael Izaguirre

(57) ABSTRACT

The present application relates to steam iron (10) comprising a soleplate (12), a discharge element (14), a retaining member (16) and a collection compartment (17). The soleplate (12) comprises a steam chamber (13) for generating steam. The steam chamber (13) comprising an opening (13A) arranged at a rear end (R) of the soleplate (12). The discharge element (14) extends from the opening (13A). The collection compartment (17) is formed in the discharge element (14) for collecting calcified deposits (S) formed in the steam chamber (13). The retaining member (16) is arranged in the discharge element (14). T retaining member (16) extends over a front end portion (P1) of the collection compartment (17) to retain the calcified deposits (S) in the collection comportment (17). This invention prevents the calcified deposits from escaping from the collection compartment when the steam iron is tilted.

14 Claims, 22 Drawing Sheets

(58) Field of Classification Search
CPC ..... B01D 46/00; B01D 46/0006; B01D 46/0009; B01D 46/001; F28G 13/00; F22B 1/28; F22B 37/48
See application file for complete search history.

(56) References Cited

U.S. PATENT DOCUMENTS

| | | | | |
|---|---|---|---|---|
| 5,621,988 | A * | 4/1997 | Bouleau | D06F 75/14 38/77.3 |
| 9,719,675 | B2 | 8/2017 | Chua | |
| 2015/0068170 | A1 | 3/2015 | Collet | |

FOREIGN PATENT DOCUMENTS

| | | | |
|---|---|---|---|
| EP | 2584090 | A2 | 4/2013 |
| EP | 2845944 | A1 * | 3/2015 |
| JP | 2013199926 | A | 10/2013 |
| WO | WO 2015010969 | A1 * | 1/2015 |
| WO | 2015101548 | A1 | 7/2015 |

* cited by examiner

STEAM IRON WITH A COLLECTION COMPARTMENT FOR CALCIFIED DEPOSITS

This application is the U.S. National Phase application under 35 U.S.C. § 371 of International Application No. PCT/EP2017/059585, filed on Apr. 24, 2017, which claims the benefit of International Application No. 16166976.7 filed on Apr. 26, 2016 and International Application No. 17162010.7 filed Mar. 21, 2017. These applications are hereby incorporated by reference herein.

FIELD OF THE INVENTION

The present invention relates to a steam iron with a collection compartment for calcified deposits.

The invention has some applications in the field of garment care.

BACKGROUND OF THE INVENTION

Steam irons are known that include a steam chamber and an ironing plate coupled to the steam chamber which contacts the garments to be ironed. The steam chamber is heated by a heating element. Water is supplied to the steam chamber and is evaporated into steam which is then expelled onto the garments through holes in the ironing plate. Over time, minerals in the water can accumulate on the steam chamber to form calcified deposits, also known as 'scale' or 'calc'. These calcified deposits may become dislodged and vented through the ironing plate onto the garment being treated by the steam iron.

There are known solutions disclosing steam irons comprising a detachable calc collector in communication with the steam chamber, so that scale particles can accumulate in the calc collector. However, it has been found that when the iron is tilted, the particles that have been collected in the calc collector may escape from the collector and pass back into the steam chamber or be vented through the steam outlet holes.

EP2584090 describes an iron having an iron sole surmounted by a radiator and a case that includes a posterior surface inscribed in a heel on which the iron rests at time of inactive ironing phases. The radiator comprises a vapor distribution system including a vaporization chamber connected to a recovery cavity of a tartar placed in back of the iron. The cavity includes a descaling opening closed by a removable stopper that is accessible from the outside of the iron. The stopper is placed on the posterior surface of the case.

EP2845944 describes an ironing apparatus comprising a steam generator connected to the steam outlet holes by a steam distribution system comprising at least one filter for retaining the scale particles transported by the steam flow, characterized in that said steam distribution system comprises a cavity of tartar recovery comprising a tartar discharge port closed by a plug removably accessed from outside the unit and in that said filter is removable from the device by the scale discharge port.

EP2584089 describes an iron (1) having a sole plate (2) that is surmounted by a radiator and a case including a heel on which the iron rests at the time of inactive phases. A descaling opening (84) is placed in a recess (33A) that is placed on the case. A removable stopper is fixed by rotation on a fixing support surrounding the descaling opening. The removable stopper removably supports a trim piece (91) that is utilized to mask the recess.

SUMMARY OF THE INVENTION

It is an object of the invention to provide a steam iron which substantially alleviates or overcomes one or more of the problems mentioned above.

The invention is defined by the independent claims. The dependent claims define advantageous embodiments.

According to the present invention, there is provided a steam iron comprising: a soleplate comprising a steam chamber for generating steam, the steam chamber comprising an opening arranged at a rear end of the soleplate; a discharge element extending from the opening; a collection compartment formed in the discharge element for collecting calcified deposits formed in the steam chamber, a retaining member arranged in the discharge element, the retaining member extending over a front end portion of the collection compartment to retain the calcified deposits in the collection compartment.

Calcified deposits in the collection compartment therefore accumulate under the retaining member in the front end portion of the collection compartment such that when the steam iron is tilted the retaining member prevents the calcified deposits from escaping from the collection compartment. Thus, the retaining member prevents the calcified deposits from returning to the steam chamber or being vented through the soleplate onto the garment being treated by the steam iron.

Preferably, the discharge element comprises a duct extending from the opening and a scale collector having walls defining the collection compartment, the scale collector being removably attachable to the duct. This facilitates removal of calcified deposits from the collection compartment because the user can remove the scale collector from the duct to empty the collection compartment.

In one embodiment, the duct comprises the retaining member.

In another embodiment, the scale collector comprises the retaining member. Therefore, the retaining member prevents the calcified deposits from unintentionally being emptied out of the collection compartment whilst the scale collector is removed from the duct.

Preferably, the retaining member is hingedly attached to one of the walls of the scale collector. Therefore, once the scale collector has been removed from the duct the retaining member can be hingedly rotated relative to said wall of the scale collector to provide easy access to the collection compartment.

Advantageously, the walls of the scale collector include a bottom wall, the retaining member arranged to overlap the bottom wall when the scale collector is attached to the duct. Therefore, when the steam iron is in an ironing position such that the soleplate is substantially horizontal, the retaining member is above the bottom wall of the scale collector to prevent calcified deposits from escaping from the collection compartment when if the steam iron is tilted forward from the ironing position. Hence, between the retaining member and the bottom wall at least part of the (volume of the) collection compartment is configured.

The retaining member is especially configured under an angle with the sole plate being larger than 0° and especially being smaller than 90°, such as in the range of 1-45°, like 5-30°.

Preferably, the scale collector further comprises at least one aperture to allow for water in the scale collector to drain from the scale collector towards the opening. This prevents water from accumulating in the scale collector.

Advantageously, the steam iron further comprises a locking member for locking the scale collector to the duct. Therefore, the scale collector is prevented from unintentionally being removed from the duct.

Preferably, the discharge element comprises a cavity, and the scale collector is removably insertable into the cavity. Therefore, the user is able to easily attach the scale collector to duct by inserting the scale collector into the cavity of the discharge element.

Advantageously, the cavity and the scale collector are arranged to cooperate such that the scale collector is insertable into the cavity in a direction chosen among the set defined by:

- a downward direction compared to a plan formed by the soleplate; and,
- an upward direction compared to a plan formed by the soleplate;
- a lateral direction compared to a longitudinal axis of the soleplate.
- a longitudinal direction compared to a longitudinal axis of the soleplate.

Those different configurations of the cavity and the scale collector allow to make it implementable in various types of products.

Preferably, the retaining member extends over at least 5% of the collection compartment.

Advantageously, the discharge element comprises a passage to fluidly communicate the steam chamber with the collection compartment, wherein the retaining member forms a boundary surface of the passage. Thus, calcified deposits moving through the passage from the steam chamber to the collection compartment pass over the retaining member to enter the collection compartment. Preferably, the retaining member defines a planar surface.

Advantageously, the steam iron further comprises a guide surface for directing the calcified deposits from the steam chamber towards the collection compartment. This increases the proportion of calcified deposits that are collected in the collection compartment.

Preferably, the discharge element comprises an aperture for allowing removal of calcified deposits from the collection compartment and a closure for sealing the aperture.

In another embodiment, the scale collector is insertable into the discharge element in an upward direction compared to a plane formed by the soleplate for closing and sealing the collection compartment and then receiving the calcified deposits therein. The scale collector comprises a lift lever which is configured to be actuated between a locked position and an unlocked position. The lift lever is configured to be rotated to a horizontal direction in the locked position and to a downward direction in the unlocked position.

In one example the lift lever is rotated to a horizontal direction in the locked position and to a downward direction in the unlocked position when the iron is placed in an operating position for ironing or with the plane formed by the soleplate in a horizontal orientation.

In another embodiment, the lift lever comprises a handle and two lever arms. The handle comprises a first latching nib. The scale collector further comprises a main body. The main body comprises a second latching nib. The first latching nib and the second latching nib are configured to form a snap fit in the locked position correspondingly which keeps the lift lever close to the main body.

In another embodiment, the lift lever comprises a handle and two lever arms. Each lever arm comprises a rotational latch away from the end of the handle. The scale collector further comprises a main body. The main body comprises two door catches sitting at the positions correspond to the positions of the rotational latches. The rotational latches and the door catches are configured to form snap fits in the locked position correspondingly which keeps the lift lever close to the main body.

The main body may in some examples be the scale collector with the exception of the lift lever. In other examples, the main body may be a cover or door which is used to seal the collection compartment.

In another embodiment, each lever arm comprises a pivoting mechanism away from the end of the handle. Each pivoting mechanism comprises an inner side and an outer side; two first concave parts are set at the inner sides respectively for accommodating two convex parts of the main body for making the lift lever rotatable about a rotational axis. Two second concave parts are set at the outer sides respectively for accommodating two cylindrical rods fixed inside the discharge element for making the lift lever synchronously rotatable about the rotational axis on the cylindrical rods. Each second concave part comprises a hook shaped portion. Each hook shaped portion comprises an open section along its rotational circle. Each open section is configured to match with the dimension of the cylindrical rod to render the hook shaped portion to be removable therefrom in the unlocked position and to be blocked against the cylindrical rod in the locked position.

In another embodiment, the scale collector is removable and is configured for sealing the collection compartment. This embodiment may be beneficial because removal of scale from the scale collector can be accomplished at the same time that the scale collector is opened.

In another embodiment, the soleplate comprises an ironing surface on the exterior of the steam iron. The ironing surface defines an underside of the steam iron. The scale collector is configured for being removed from the underside of the steam iron. This embodiment may be beneficial because if the steam iron is placed and resting on the ironing surface when the scale collector is removed the force of gravity will keep the collected calcified deposits within the scale collector.

In another embodiment, the scale collector is cup-shaped. This embodiment may be beneficial because it may provide a means of collecting and holding the calcified deposits when the scale collector is removed when the iron is on the ironing surface.

In another embodiment the scale collector comprises a lift lever. The lift lever is configured for being actuated between a locked position and an unlocked position. The collection compartment comprises a scale collector receptacle. The scale collector comprises a scale collector sealing surface configured for mating with the scale collector receptacle. In the unlocked position, the scale collector sealing surface is configured for being inserted into or being removed from the scale collector receptacle. In the locked position the scale collector is configured for having a fixed position relative to the collection compartment. This embodiment may be beneficial because it provides an efficient means of removing the scale collector or installing it into a steam iron without the use of tools.

In another embodiment, the scale collector comprises a scoop portion extending under the lift lever. The lift lever is mounted flush with an exterior surface of the scale collector except for the scoop portion. This embodiment may be beneficial because this arrangement provides for an easy means of manually actuating the lift lever but having most of its exterior surface flush helps to prevent it from being actuated unintentionally.

In another embodiment, the lift lever is configured for being rotated towards the ironing surface. This embodiment may be beneficial because the fingers can be moved towards the lift lever from an exterior direction towards the iron. This may facilitate the actuation of the lift lever without seeing it. For instance the steam iron could be placed on its ironing surface and then actuated without the user or operator visually seeing the lift lever while actuating it.

In another embodiment, the lift lever comprises a handle. The lift lever comprises two lever mechanisms. The handle connects the two lever mechanisms. This embodiment may be beneficial because the handle may provide for a means of locking the scale collector on two sides.

In another embodiment, the handle comprises a first latching nib. The scale collector comprises a second latching nib. The first latching nib and the second latching nib form a snap fit in the locked position. This embodiment may be beneficial because it may prevent accidental actuation of the lift lever.

In another embodiment, each of the two lever mechanisms comprises a pivot for rotating about a rotational axis. Both pivots may rotate around the same rotational axis. Each of the two lever mechanisms comprises a hook-shaped portion. The hook-shaped portion comprises a cylindrically symmetric portion configured for rotating about the rotational axis. The hook-shaped portion comprises an open section. The steam iron comprises a cylindrical rod for each of the two lever mechanisms. In the unlocked position each open section of the two lever mechanisms is configured for mating with the cylindrically symmetric portion and for being removed from the cylindrically symmetric portion. In the locked position the cylindrical portion of each of the two lever mechanisms is locked against the cylindrical rod. For example the open section is rotated so that the cylindrically symmetric portion can no longer be removed from the cylindrical rods. This embodiment may provide for an extremely efficient and secure means of locking the scale collector on two sides.

In another embodiment, the cylindrical rod has a first diameter. The cylindrical portion has a second diameter. The second diameter is the same or as large as the first diameter. This may provide for a bearing surface about which the hook-shaped portion can rotate efficiently. In some examples the second diameter and the first diameter are adjusted such that the cylindrical rod and the cylindrical portion form a smooth rotating fit.

In another embodiment, the cylindrical rod has a cylindrical axis. The cylindrical axis is aligned with the rotational axis in the locked position.

In another embodiment, each of the two level mechanisms comprises a rotational latch configured for forming a snap fit with a door catch in the locked position. This embodiment may be beneficial because it may provide for an efficient means of ensuring that the lift lever is not opened automatically.

In another embodiment, the scale collector sealing surface comprises an elastomeric surface for forming a seal between the scale collector receptacle and the scale collector sealing surface. This may be beneficial because it may prevent the leaking of water or steam from the collection compartment.

In another embodiment, the elastomeric surface comprises a double wiper formed from the elastomeric surface. The double wiper comprises a leading wiper and a sealing wiper. The double wiper is configured for being inserted into the scale collector receptacle first and for wiping the calcified deposits away from the sealing wiper. This embodiment may be beneficial because it may provide for a more efficient means of sealing the collection compartment when the operator has not completely cleaned it and is reinserting the scale collector.

In another embodiment, the steam iron comprises at least one drainage duct between the steam chamber and the collection compartment. When the steam iron is placed on the ironing surface the at least drainage duct is configured for draining water from the collection compartment into the steam chamber. This may provide for an efficient means of preventing the collection compartment from filling with water over repeated use.

In another embodiment, the steam iron comprises a heel. The heel may also be considered to be a base which the steam iron can rest on when the steam iron is not placed on the ironing surface.

In another embodiment, the steam iron is configured for resting on the heel.

In another embodiment, placing the steam iron on the heel defines a rest position for the steam iron. In the rest position the steam chamber is above the collection chamber. This may have the benefit that the calcified deposits will fall into the collection compartment due to gravitational force.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
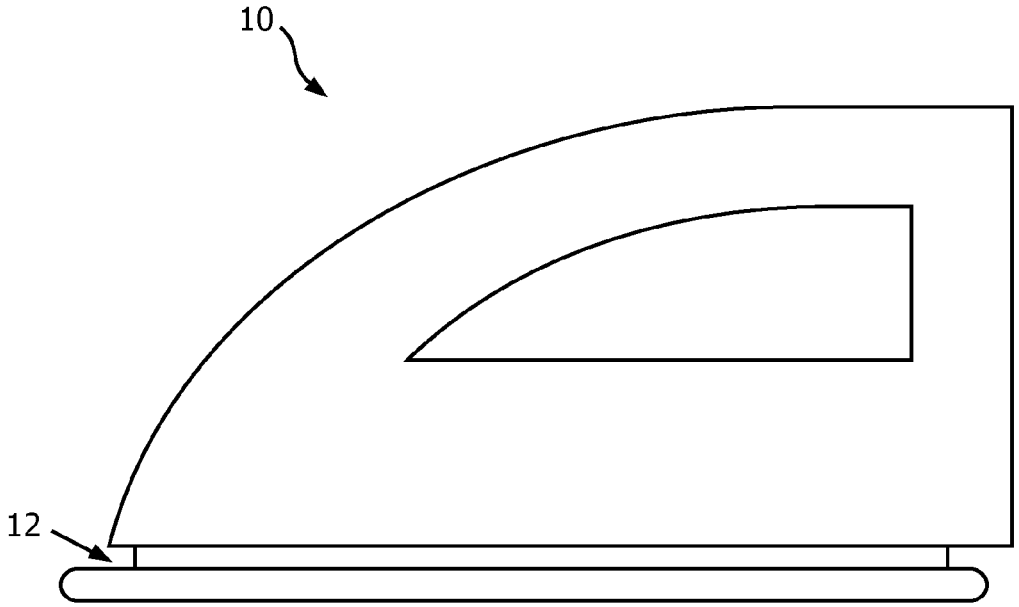
FIG. 1 is a schematic side view of a steam iron according to an embodiment of the invention.

Referring now to FIGS. 1 to 5, a steam iron 10 according to an embodiment of the invention is shown.

The steam iron 10 comprises a soleplate 12, a discharge element 14, a retaining member 16 and a collection compartment 17.

The soleplate 12 comprises a steam chamber 13 for generating steam. The steam chamber 13 comprises an opening 13A arranged at a rear end R of the soleplate 12. The discharge element 14 extends from the opening 13A.

The collection compartment 17 is formed in the discharge element 14 for collecting calcified deposits S formed in the steam chamber 13.

The retaining member 16 is arranged in the discharge element 14. The retaining member 16 extends over a front end portion P1 of the collection compartment 17 to retain the calcified deposits S in the collection compartment 17. The front end portion P1 is a portion of the collection compartment 17 facing the opening 13A. Therefore, calcified deposits S in the collection compartment 17 accumulate under the retaining member 16 in the front end portion P1 of the collection compartment 17 such that when the steam iron 10 is tilted the retaining member 16 prevents the calcified deposits S from escaping from the collection compartment 17. Advantageously, the retaining member 16 therefore prevents the calcified deposits S from returning to the steam chamber 13 or being vented through the soleplate 12 onto the garment being treated by the steam iron 10.

For example, the retaining member and the scale collector are made of any materials having a good dimensional stability at high temperature (>200 dgr C.), such as plastics (e.g. Polyphenylene sulfide PPS) or metals.

In one embodiment, the discharge element 14 comprises a scale collector 11 and a duct 15. The duct 15 extends from the opening 13A of the steam chamber 13. The scale collector 11 comprises walls 20, 21 defining the collection compartment 17. The scale collector 11 is removably attachable to the duct 15.

In one embodiment, the duct 15 comprises the retaining member 16, as illustrated in FIGS. 2 to 5.

Optionally, the walls 20, 21 of the scale collector 11 include a bottom wall 20 and the retaining member 16 is arranged to overlap the bottom wall 20 when the scale collector 11 is attached to the duct 15.

In one embodiment, the retaining member 16 extends over at least 5% of the collection compartment 17.

Optionally, the retaining member 16 extends over at least 5% of the surface of the bottom wall 20 of the scale collector 11.

Optionally, the retaining member 16 defines a planar surface.

Figure 4:
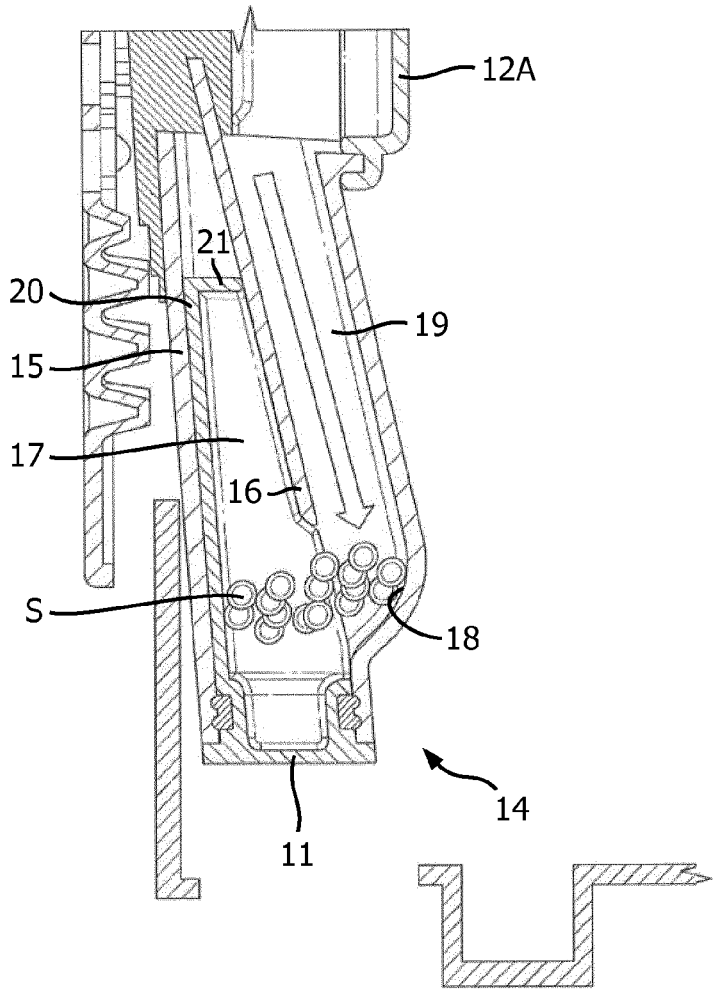
FIG. 4 is a cross-sectional side view of part of the steam iron of FIG. 1, wherein the soleplate is in a rest position.

In one embodiment, the steam iron 10 further comprises a guide surface 18 for directing the calcified deposits S from the steam chamber 13 towards the collection compartment 17. The guide surface 18 may be a curved surface 18, as illustrated in FIG. 4. In an alternative embodiment (not shown), the guide surface 18 is a planar surface that is angled to direct calcified deposits S from the steam chamber 13 towards the collection compartment 17.

Figure 2:
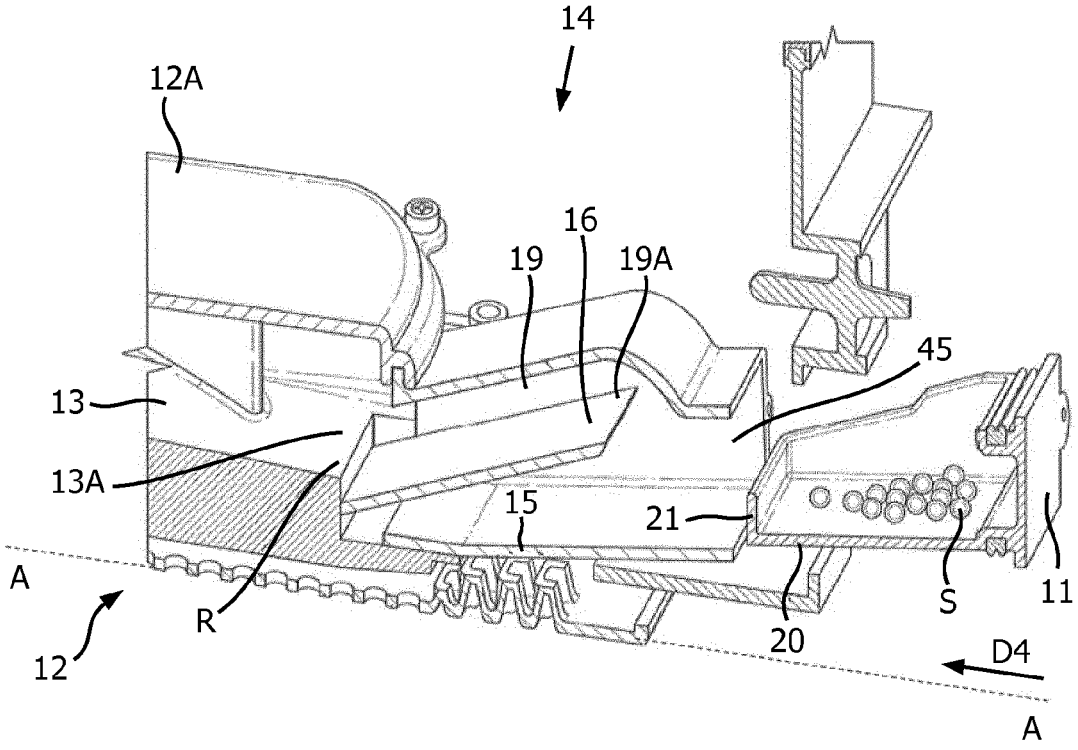
FIG. 2 is a cross-sectional perspective view of part of the steam iron of FIG. 1, wherein a scale collector is removed from a duct of the steam iron.
Figure 3:
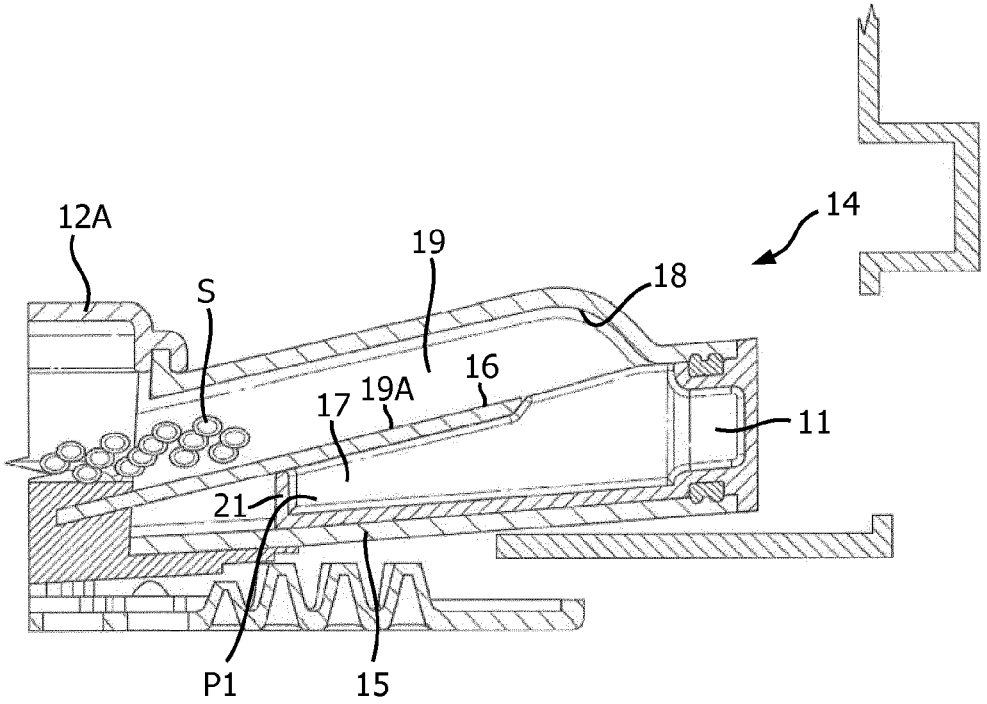
FIG. 3 is a cross-sectional side view of part of the steam iron of FIG. 1, wherein a soleplate of the steam iron is in an ironing position.
Figure 5:
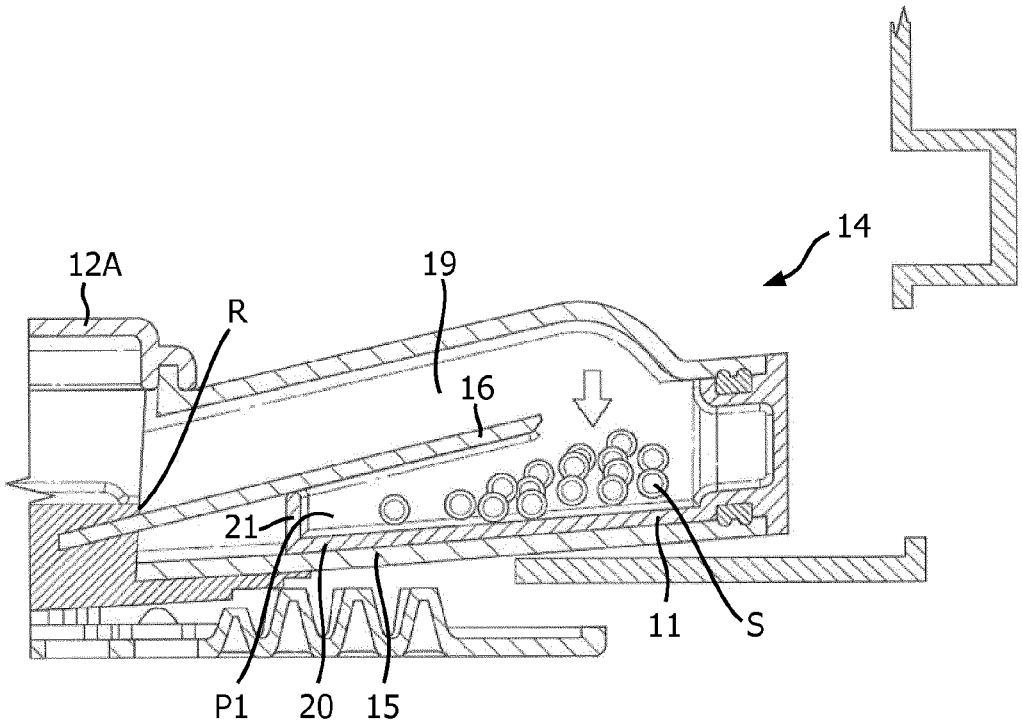
FIG. 5 is a cross-sectional side view of part of the steam iron of FIG. 1, wherein the soleplate is in an ironing position and scale is collected in a scale collector of the steam iron.

FIGS. 2 to 5 illustrate an exemplary use of the steam iron 10. In FIG. 3, the steam iron 10 is in an ironing position, wherein the soleplate 12 is substantially horizontal, and the calcified deposits S are located in proximity to the opening 13A of the steam chamber 13. In FIG. 4, the steam iron 10 is moved from the ironing position to a rest position, wherein the soleplate is moved towards a vertical orientation. This causes the calcified deposits S in the steam chamber 13 to move through the duct 15 towards the rear of the steam iron 10, wherein the calcified deposits S contact the guide surface 18 and move into the collection compartment 17 of the scale collector 11. In FIG. 5, the steam iron 10 is moved back to the ironing position and the calcified deposits S move into the front end portion P1 of the collection compartment 17 such that the calcified deposits S are located under the retaining member 16. If the steam iron 10 is then tilted forward from the ironing position (i.e. such that the rear end R of the soleplate 12 is higher than the distal front end of the soleplate 12) then the retaining member 16 will prevent the calcified deposits S in the front end portion P1 of the collection compartment 17 from escaping out of the scale collector 11. The user is able to remove the scale collector 11 from the duct 15 to empty the scale collection compartment 17 (as shown in FIGS. 2-3).

The retaining member may allow a rotation of the steam iron from a horizontal configuration (see e.g. FIG. 2 or 3), with the soleplate configured horizontal to a configuration perpendicular thereto, such as in a rest position, such as e.g. in FIG. 4, with the collection compartment up and a nose of the steam iron down, while at least part of deposits S stays in the collection compartment 17, as the retaining member extends over a front end portion of the collection compartment. The retaining member allows ingress of deposits via passage 19 into the collection compartment 17.

Figure 6:
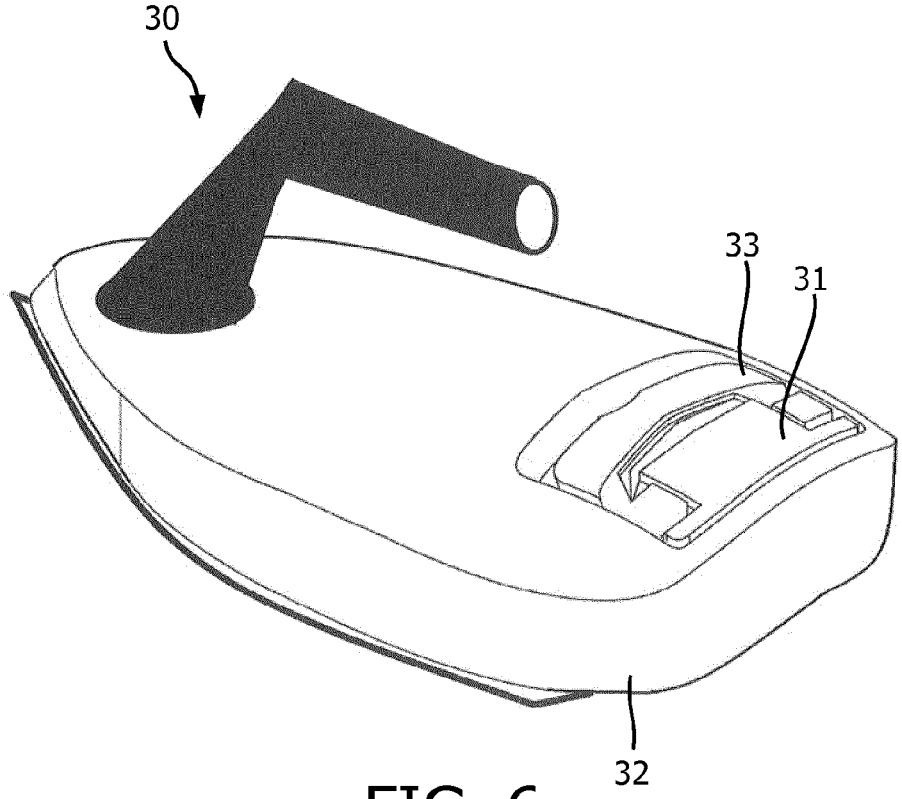
FIG. 6 is a perspective view of a steam iron according to another embodiment of the invention.
Figure 7:
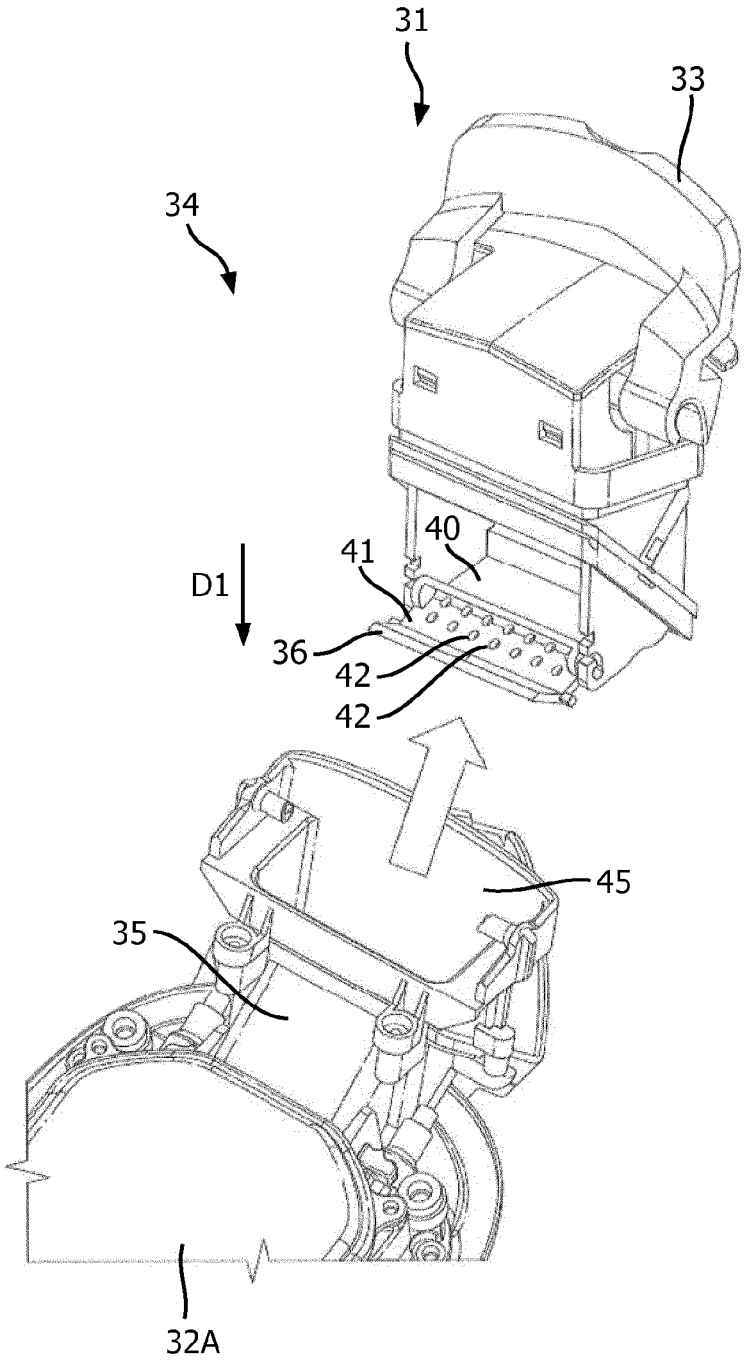
FIG. 7 is a perspective view of a discharge element of the steam iron of FIG. 6.
Figure 8:
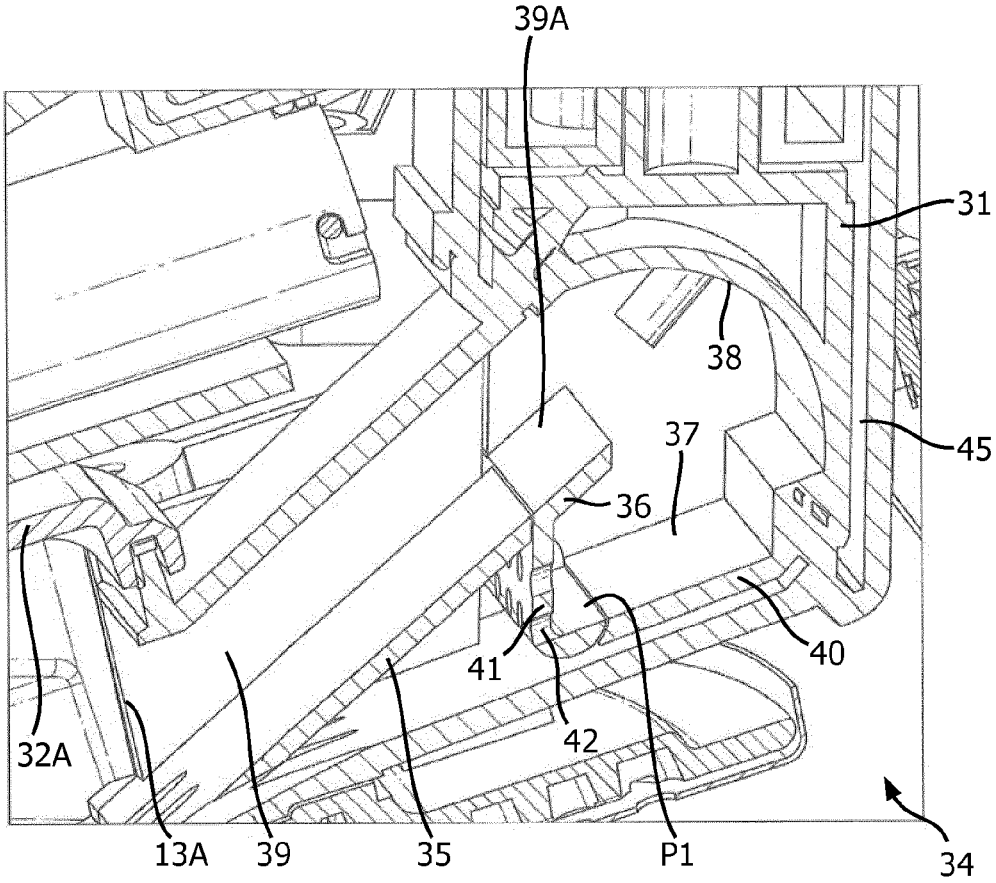
FIG. 8 is a cross-sectional perspective view of the discharge element of FIG. 7.

Referring now to FIGS. 6 to 8, a steam iron 30 according to another embodiment of the invention is shown.

The steam iron 30 comprises a soleplate 32, a discharge element 34, a retaining member 36 and a collection compartment 37.

The soleplate 32 comprises a steam chamber for generating steam. The steam chamber comprises an opening 13A arranged at a rear end of the soleplate 32. The discharge element 34 extends from the opening 13A.

The collection compartment 37 is formed in the discharge element 34 for collecting calcified deposits formed in the steam chamber.

The retaining member 36 is arranged in the discharge element 34. The retaining member 36 extends over a front end portion P1 of the collection compartment 37 to retain the calcified deposits in the collection compartment 37. Therefore, calcified deposits in the collection compartment 37 accumulate under the retaining member 36 in the front end portion P1 of the collection compartment 37 such that when the steam iron 30 is tilted the retaining member 36 prevents the calcified deposits from escaping from the collection compartment 37. Advantageously, the retaining member 36 therefore prevents the calcified deposits from returning to the steam chamber or being vented through the soleplate 32 onto the garment being treated by the steam iron 30.

Optionally, the discharge element 34 comprises a scale collector 31 and a duct 35. The duct 35 extends from the opening 13A of the steam chamber. The scale collector 31 has walls 40, 41 defining the collection compartment 37. The scale collector 31 is removably attachable to the duct 35.

In one embodiment, the scale collector 31 comprises the retaining member 36, as illustrated in FIG. 8. Optionally, the retaining member 36 is hingedly attached to one of the walls 40 of the scale collector 31.

Optionally, the walls 40, 41 of the scale collector 31 include a bottom wall 40. The retaining member 36 is arranged to overlap the bottom wall 40 when the scale collector 31 is attached to the duct 35.

In one embodiment, the scale collector 31 further comprises at least one aperture 42 to allow for water in the scale collector 31 to drain from the scale collector 31 towards the opening 13A of the steam chamber, as illustrated in FIGS. 7 and 8. For sake of simplicity, the aperture 42 is only shown in FIG. 7 and FIG. 8, but same or similar aperture could be implemented in embodiments of FIG. 2 to 5, FIGS. 9 to 11.

In one embodiment, the steam iron 30 further comprises a locking member 33 for locking the scale collector 31 to the duct 35, as illustrated in FIGS. 6 and 7. The locking member 33 may be hingedly attached to a part of the scale collector 31. The locking member 33 may be hingedly rotated from an unlocked position to a locked position when the scale collector 31 is attached to the duct 35 to lock the scale collector 31 to the duct 35. For sake of simplicity, the same or similar locking member could be implemented also in embodiments of FIGS. 2 to 5 and FIGS. 9 to 11.

Optionally, the discharge element 34 comprises a cavity 45 and the scale collector 31 is removably insertable into the cavity 45. In the embodiment illustrated in FIGS. 6 to 8, the cavity 45 and the scale collector 31 are arranged to cooperate such that the scale collector 31 is insertable into the cavity 45 in a downward direction (shown by arrow 131' in FIG. 7) compared to a plan formed by the soleplate 32. The scale collector 31 may be insertable into the cavity 45 in a direction that is substantially perpendicular to an ironing surface of the soleplate 32.

In one embodiment, the retaining member 36 extends over at least 5% above the collection compartment 37. In other words, the vertical projection of the retaining member 36 on a bottom surface of the collection compartment 37 is at least 5% of said bottom surface.

In another embodiment, the retaining member 36 extends over at least 5% of the surface of the bottom wall 40 of the scale collector 31. In other words, the vertical projection of the retaining member 36 on a bottom wall 40 is at least 5% of the surface of said bottom surface 40.

The retaining member 36 preferably defines a planar surface.

In one embodiment, the discharge element 34 comprises a guide surface 38 for directing the calcified deposits from the steam chamber towards the collection compartment 37. The guide surface 38 may be a curved surface 38, as illustrated in FIG. 8. In an alternative embodiment (not shown), the guide surface 38 is a planar surface that is angled to direct calcified deposits from the steam chamber towards the collection compartment 37.

Figure 9:
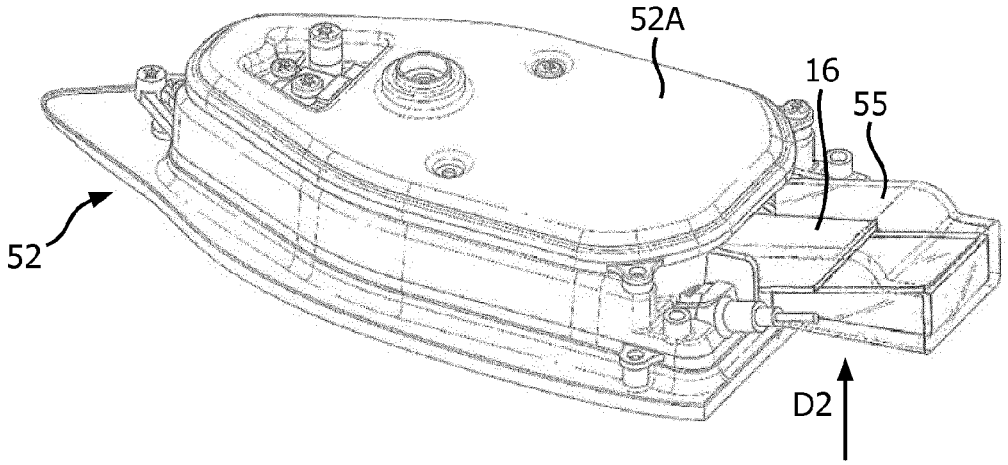
FIG. 9 is a perspective view of a part of a steam iron according to another embodiment of the invention.
Figure 10:
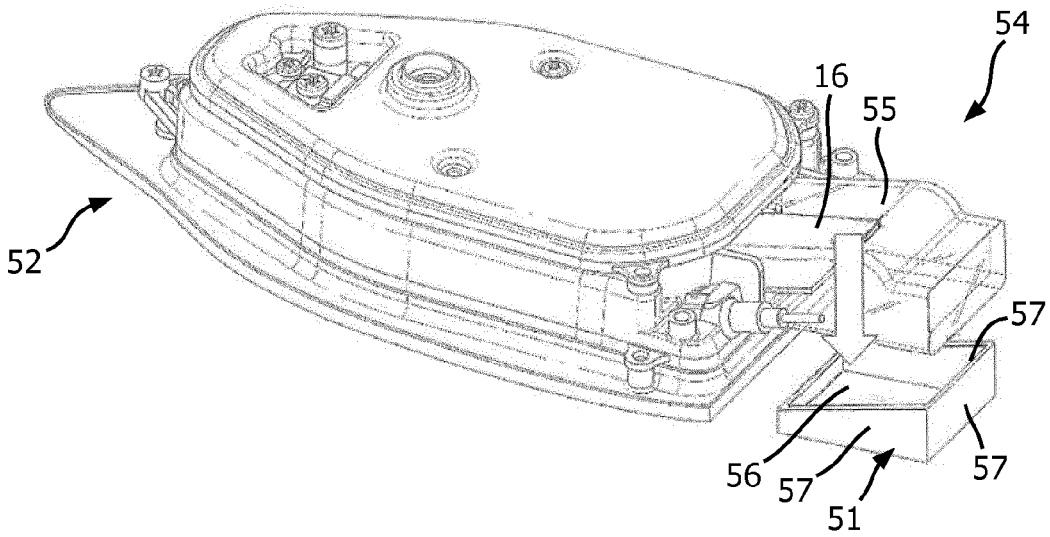
FIG. 10 is a perspective view of the part of the steam iron of FIG. 9, wherein a scale collector is removed from a duct of the steam iron.

Referring now to FIGS. 9 and 10, part of a steam iron according to another embodiment of the invention is shown. The steam iron shown in FIGS. 9 and 10 is similar to the steam iron 10 described above in relation to FIGS. 1 to 5, comprising a soleplate 52, a discharge element 54, a retaining member (not shown) and a collection compartment (now shown). The soleplate 52 comprises a steam chamber (not shown) for generating steam. The steam chamber comprises an opening arranged at a rear end of the soleplate 52. The discharge element 54 extends from the opening. As described above, the collection compartment is formed in the discharge element 54 for collecting calcified deposits formed in the steam chamber and the retaining member is arranged in the discharge element 54, extending over a front end portion of the collection compartment to retain the calcified deposits in the collection compartment. Therefore, the retaining member prevents calcified deposits in the collection compartment from returning to the steam chamber or being vented through the soleplate 52 onto the garment being treated by the steam iron.

As described above, the discharge element 54 comprises a duct 55 extending from the opening and a scale collector 51 having walls 56, 57 defining the collection compartment. The scale collector 51 is removably attachable to the duct 55. In addition, the discharge element 54 comprises a cavity (not shown) and the scale collector 51 is removably insertable into the cavity. However, unlike the embodiment illustrated in FIGS. 1 to 5, the cavity and the scale collector 51 of the embodiment illustrated in FIGS. 9 and 10 are arranged to cooperate such that the scale collector 51 is insertable into the cavity in an upward direction (shown by arrow 'D2' in FIG. 9) compared to a plan formed by the soleplate 52. The scale collector 51 may be insertable into the cavity in a direction that is substantially perpendicular to an ironing surface of the soleplate 52.

Optionally, the walls 56, 57 of the scale collector 51 include a bottom wall 56 and the retaining member is arranged to overlap the bottom wall 56 when the scale collector 51 is attached to the duct 55.

Figure 11:
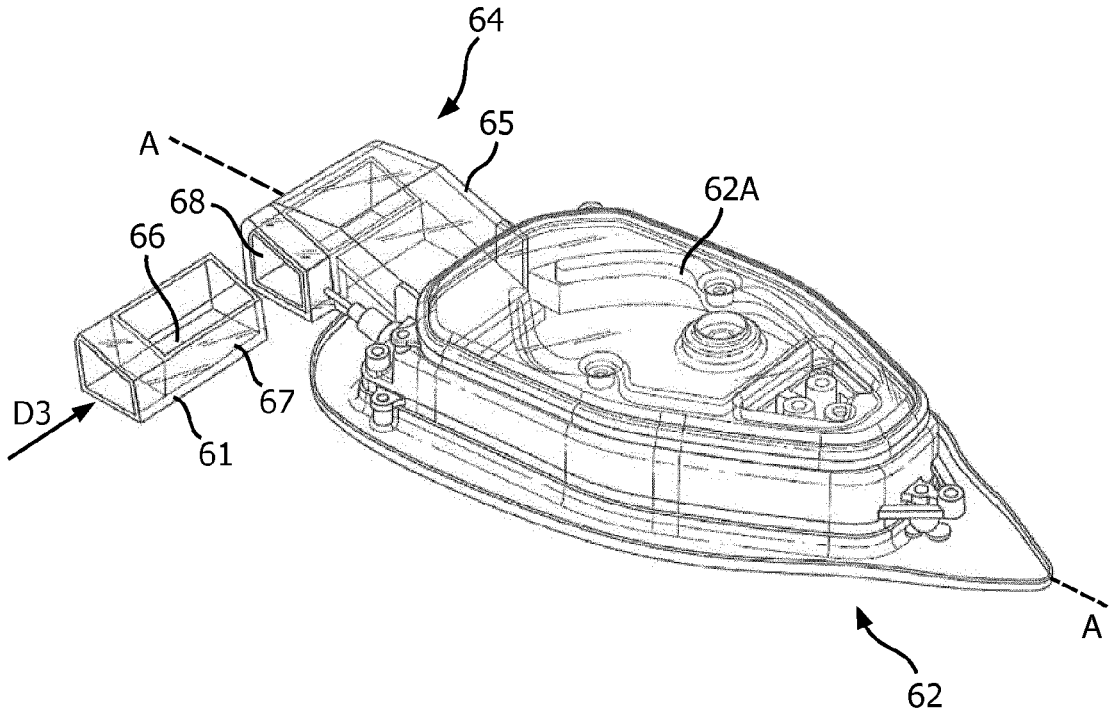
FIG. 11 is a perspective view of part of a steam iron according to another embodiment of the invention, wherein a scale collector is removed from a duct of the steam iron; and, FIG. 12 is a cross-sectional side view of part of a steam iron according to another embodiment of the invention.

Referring now to FIG. 11, part of a steam iron according to another embodiment of the invention is shown. The steam iron shown in FIG. 11 is similar to the steam iron 10 described above in relation to FIGS. 1 to 5, comprising a soleplate 62, a discharge element 64, a retaining member (not shown) and a collection compartment (now shown). The soleplate 62 comprises a steam chamber (not shown) for generating steam. The steam chamber comprises an opening arranged at a rear end of the soleplate 62. The discharge element 64 extends from the opening. As described above, the collection compartment is formed in the discharge element 64 for collecting calcified deposits formed in the steam chamber and the retaining member is arranged in the discharge element 64, extending over a front end portion of the collection compartment to retain the calcified deposits in the collection compartment. Therefore, the retaining member prevents calcified deposits in the collection compartment from returning to the steam chamber or being vented through the soleplate 62 onto the garment being treated by the steam iron.

As described above, the discharge element 64 comprises a duct 65 extending from the opening of the steam chamber and a scale collector 61 having walls 66, 67 defining the collection compartment. The scale collector 61 is removably attachable to the duct 65. In addition, the discharge element 64 comprises a cavity 68 and the scale collector 61 is removably insertable into the cavity 68. However, unlike the embodiment illustrated in FIGS. 1 to 5, the cavity 68 and the scale collector 61 of the embodiment illustrated in FIG. 11 are arranged to cooperate such that the scale collector 61 is insertable into the cavity 68 in a lateral direction (shown by arrow 'D3' in FIG. 11) compared to a longitudinal axis (shown by dotted line 'A-A' in FIG. 11) of the soleplate 62.

Optionally, the walls 66, 67 of the scale collector 61 include a bottom wall 66 and the retaining member is arranged to overlap the bottom wall 66 when the scale 61 is attached to the duct 65.

Figure 12:
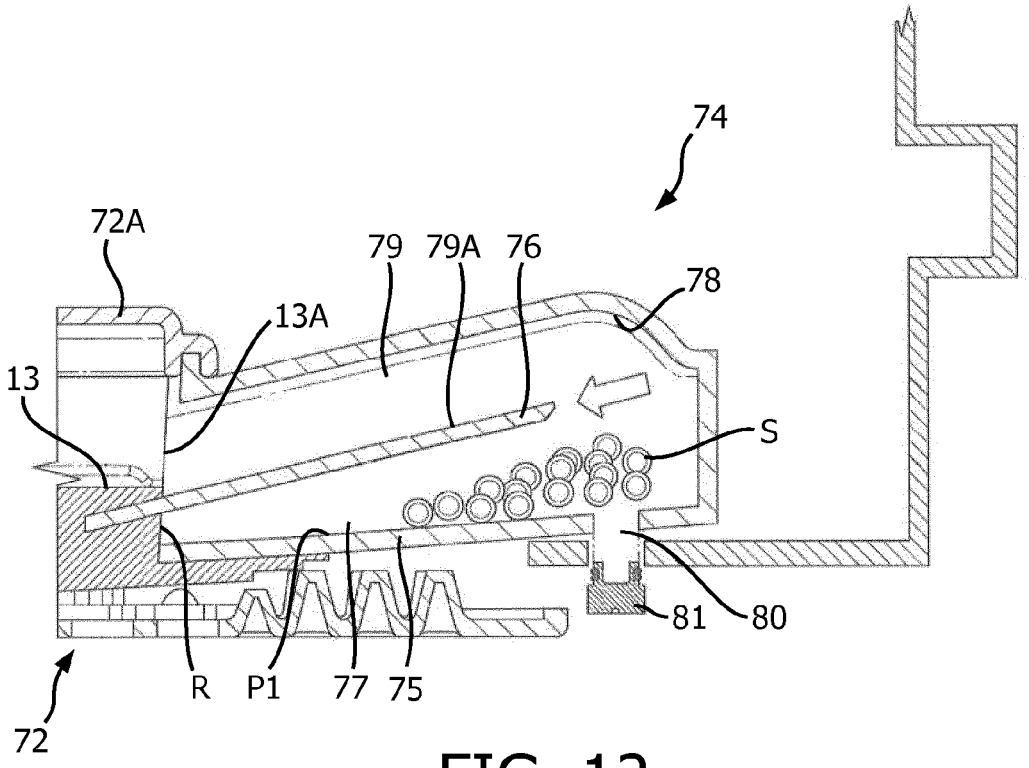

Referring now to FIG. 12, part of a steam iron according to another embodiment of the invention is shown. The steam iron shown in FIG. 12 is similar to the steam iron 10 described above in relation to FIGS. 1 to 5, comprising a soleplate 72, a discharge element 74, a retaining member 76 and a collection compartment 77. The soleplate 72 comprises a steam chamber 13 for generating steam. The steam chamber 13 comprises an opening 13A arranged at a rear end R of the soleplate 72. The discharge element 74 extends from the opening 13A.

As described above, the collection compartment 77 is formed in the discharge element 74 for collecting calcified deposits S formed in the steam chamber 13 and the retaining member 76 is arranged in the discharge element 74, extending over a front end portion P1 of the collection compartment 77 to retain the calcified deposits S in the collection compartment 77. Therefore, the retaining member 76 prevents the calcified deposits S from returning to the steam chamber 13 or being vented through the soleplate 72 onto the garment being treated by the steam iron. A difference is that the discharge element 74 of the steam iron of the embodiment shown in FIG. 12 does not comprise a removable scale collector. Instead, the discharge element 74 comprises a duct 75 that extends from the opening 13A of the steam chamber 13 to form an enclosure that forms the collection compartment 77.

In one embodiment, an aperture 80 is provided in the duct 75 to provide access to the collection compartment 77 to allow for removal of calcified deposits S from the collection compartment 77. A closure 81 is provided to seal the aperture 80 to prevent calcified deposits S from escaping out of the collection compartment 77. In one such embodiment, the closure 81 comprises a stopper 81 that is removably insertable into the aperture 80 to prevent calcified deposits S from escaping out of the collection compartment 77. The user can remove the stopper 81 from the aperture 80 to empty the collection compartment 77.

In some embodiments, the discharge element 14, 34, 54, 64, 74 comprises a passage 19, 39, 79 to fluidly communicate the steam chamber 13 with the collection compartment 17, 37, 77. The retaining member 16, 36, 76 may form a boundary surface 19A, 39A, 79A of the passage 19, 39, 79.

In some embodiments, the soleplate 12, 32, 52, 62, 72 comprises a cover 12A, 32A, 52A, 62A, 72A. The discharge element 14, 34, 54, 64, 74 may be connected to the cover 12A, 32A, 52A, 62A, 72A.

In some embodiments, the retaining member 16, 36, 76 is arranged such that when the steam iron 10, 30 is tilted away from an ironing position in a first direction, towards a rested position, calcified deposits S in the steam chamber 13 fall towards the collection compartment 17, 37, 77 under the effect of gravity. Moreover, when the steam iron 10, 30 is tilted away from a rest position to the ironing position, calcified deposits S in the collection compartment 17, 37, 77 are retained in the collection compartment 17, 37, 77 by the retaining member 16, 36, 76. In the ironing position, the soleplate 12, 32, 52, 62, 72 may be substantially horizontal. In the rest position, the soleplate 12, 32, 52, 62, 72 is at an angle with respect to the horizontal, and may be substantially vertical.

Figure 13:
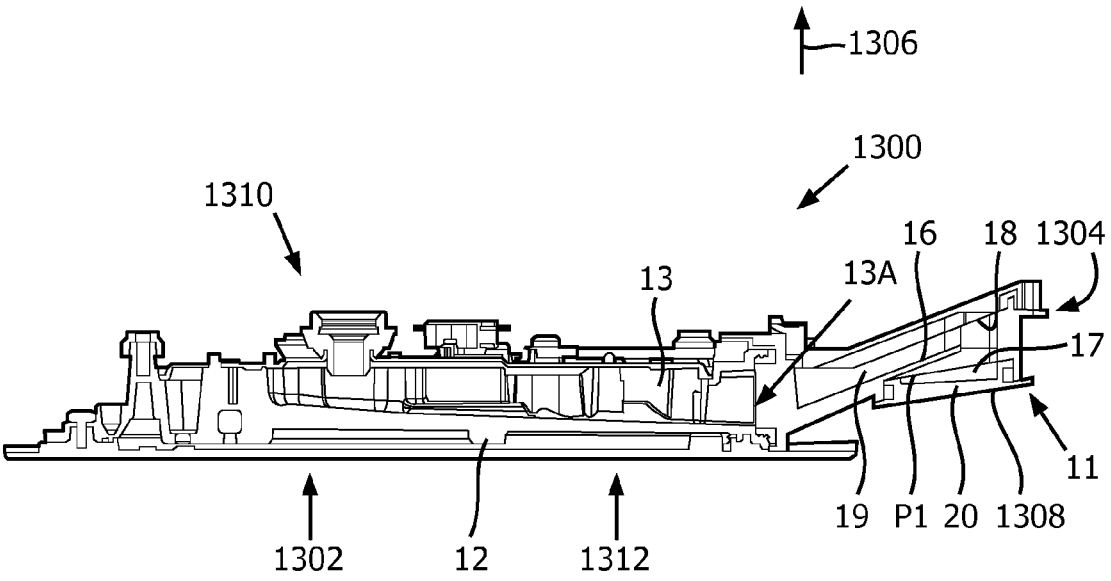
FIG. 13 illustrates a further example of a steam iron.

FIG. 13 shows a further example of a steam iron 1300. The example shown in FIG. 13 is similar to the examples illustrated in FIGS. 9 and 10. Not all components are shown in FIG. 13. The soleplate 12 and the steam chamber 13 can be seen. In this example the scale collector 11 is formed by a scale collector 1308. The arrow labeled 1306 points in an upward direction. When the soleplate 12 is laid mostly horizontal an exterior surface defines an ironing surface 1302. When the iron 1300 is used to iron clothes the ironing surface 1302 comes in contact with the garment or fabric. The examples in FIGS. 13-34 are used to illustrate variance of the scale collector 1308 and the mechanism for attaching it or detaching it from the steam iron 1300. It can be seen that the scale collector 1308 forms a bottom wall 20 of the collection compartment 17. The steam iron 1300 is also shown as having a heel 1304. The outer case or housing of the steam iron 1300 is not shown. In many examples, the steam iron 1300 will have an outer case which has a surface upon which the steam iron 1300 can be rested upon or placed into a cradle so that the ironing surface 1302 is no longer horizontal and is held away from contacting any surface.

Figure 14:
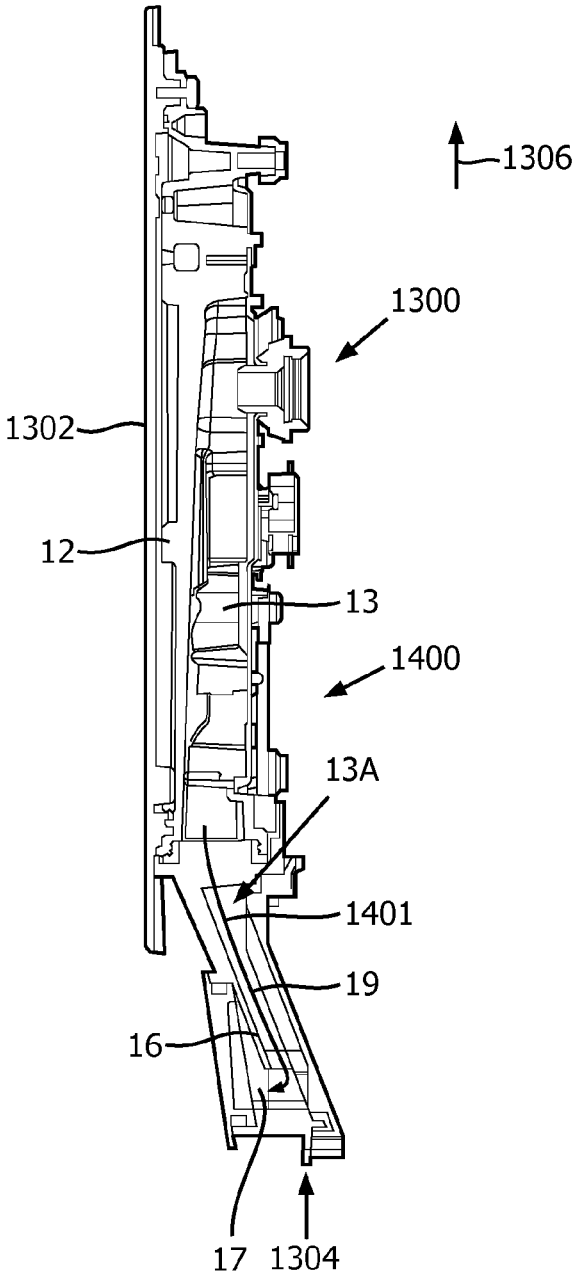
FIG. 14 shows a further view of the seam iron of FIG. 13.

FIG. 14 shows another view of the steam iron 1300. In FIG. 14 the steam iron 1300 has either been placed on its heel 1304 or has been placed into a cradle which supports the heel 1304. Scale which is in the steam chamber 13 may then follow the arrow 1400 travelling through the opening 13*a* and along the passage into the collection compartment 17. In FIG. 14 the steam iron 1300 is shown in the heel rest position 1400. In FIG. 13 the steam iron 1300 is in an ironing position 1310. The ironing position 1310 defines an underside 1312 of the iron. When the steam iron 1300 has transitioned from the ironing position 1310 to the heel rest position 1400 the scale follows a path 1401. As the iron is then tilted back into the ironing position 1310 the retaining member 16 prevents the scale from going back into the steam chamber 13.

Figure 15:
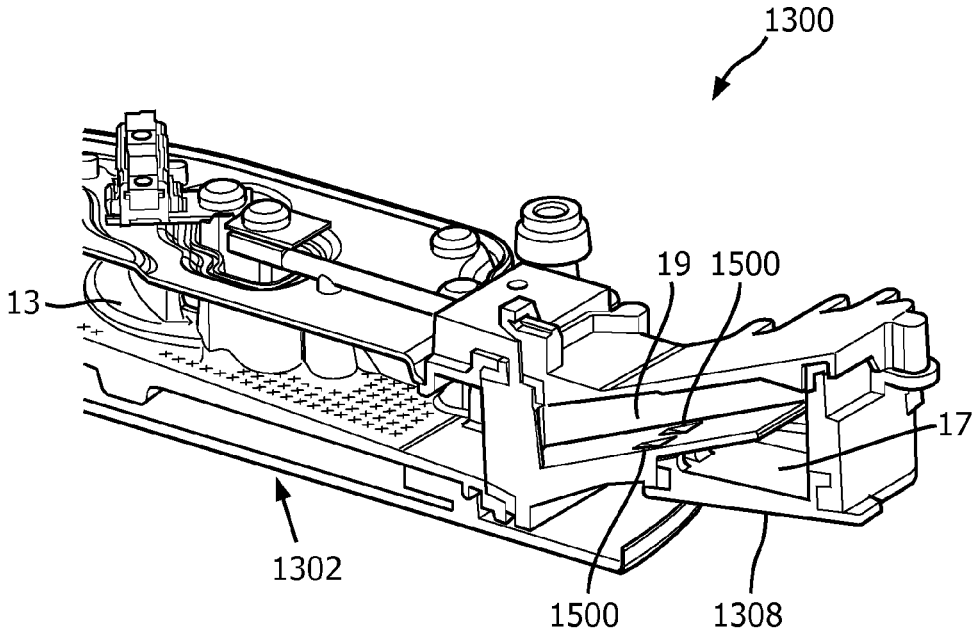
FIG. 15 shows a further view of the steam iron of FIG. 13.
Figure 16:
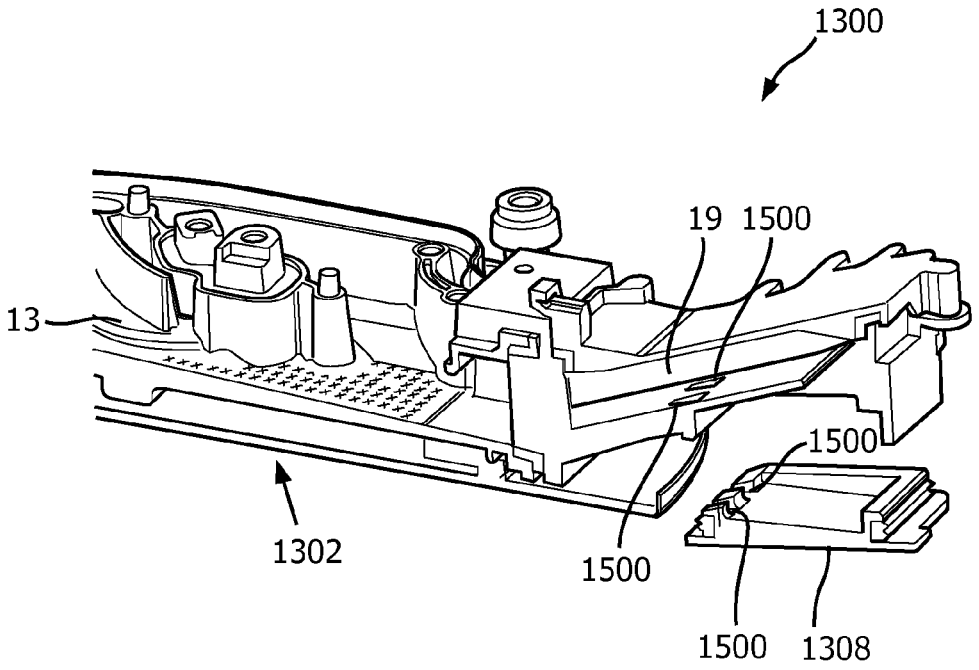
FIG. 16 shows a further view of the steam iron of FIG. 13.

FIGS. 15 and 16 show two further isometric cross-sectional views of the steam iron 1300. In FIG. 15 the scale collector 1308 is shown as being installed into the steam iron 1300. In FIG. 16 the scale collector 1308 is shown as having been removed. The collection compartment 17 is shown as having two drainage ducts 1500. When the steam iron 1300 is in the ironing position 1310 gravity will cause water within the collection compartment to drain back into the steam chamber 13.

FIGS. 17-30 illustrate an example of a steam iron 1700 that is a variant of the steam iron 1300 illustrated in FIGS. 13-16.

Figure 17:
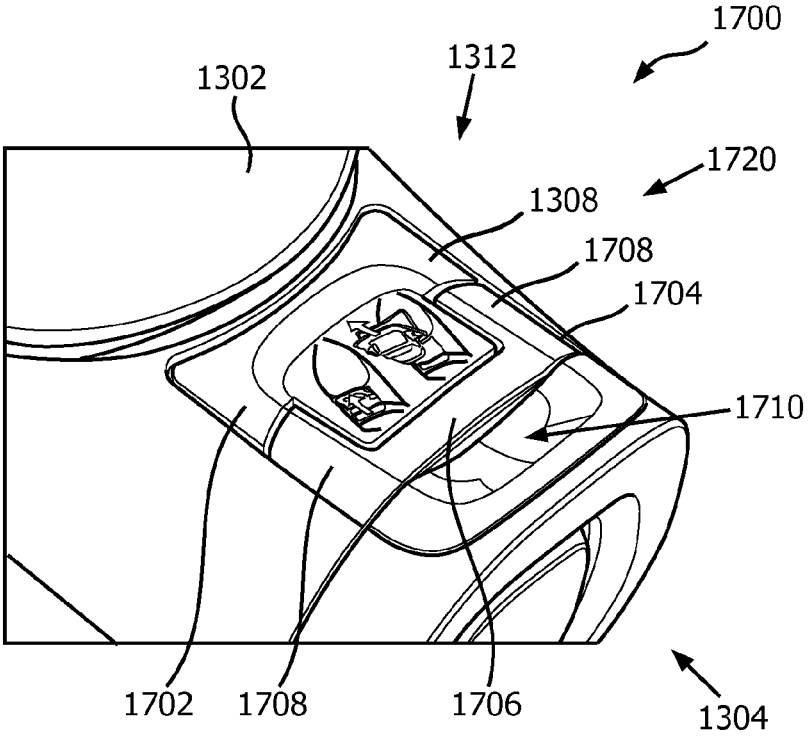
FIG. 17 shows an example of a scale collector installed into a further example of a steam iron.
Figure 18:
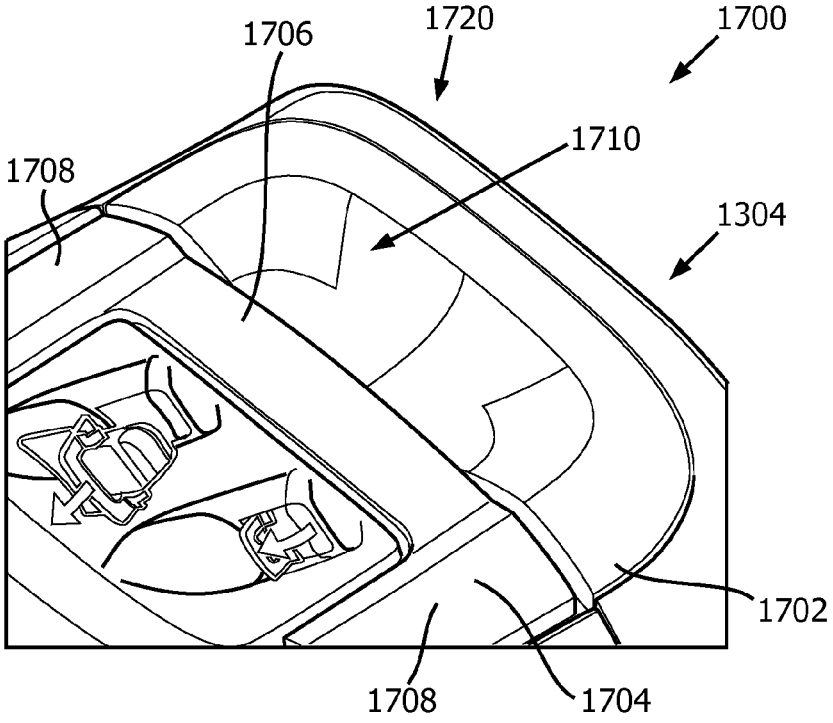
FIG. 18 shows a further view of the scale collector and steam iron of FIG. 17.

FIG. 17 shows a view of the underside 1312 of the steam iron 1700. The scale collector 1308 is shown as having a lift lever 1704 which can be used to lock and unlock the scale collector 1308 from the steam iron 1700. FIG. 18 shows the same view of the underside of the steam iron 1700 from a different angle. The lift lever 1704 can be shown as comprising a handle 706 which connects to lever arms 1708 of a lever mechanism. The lift lever 1704 is shown as being flush with an exterior surface 1702 of the scale collector 1308 with the exception of a scoop portion 1710 which extends under the handle 1706 of the lift lever 1704. The scoop portion 1710 enables an operator to place their fingers or fingernails behind the handle 1706 to lift it in order to actuate the lever mechanisms 1708. The lift lever 1704 in FIGS. 17 and 18 is shown in a locked position 1720.

Figure 19:
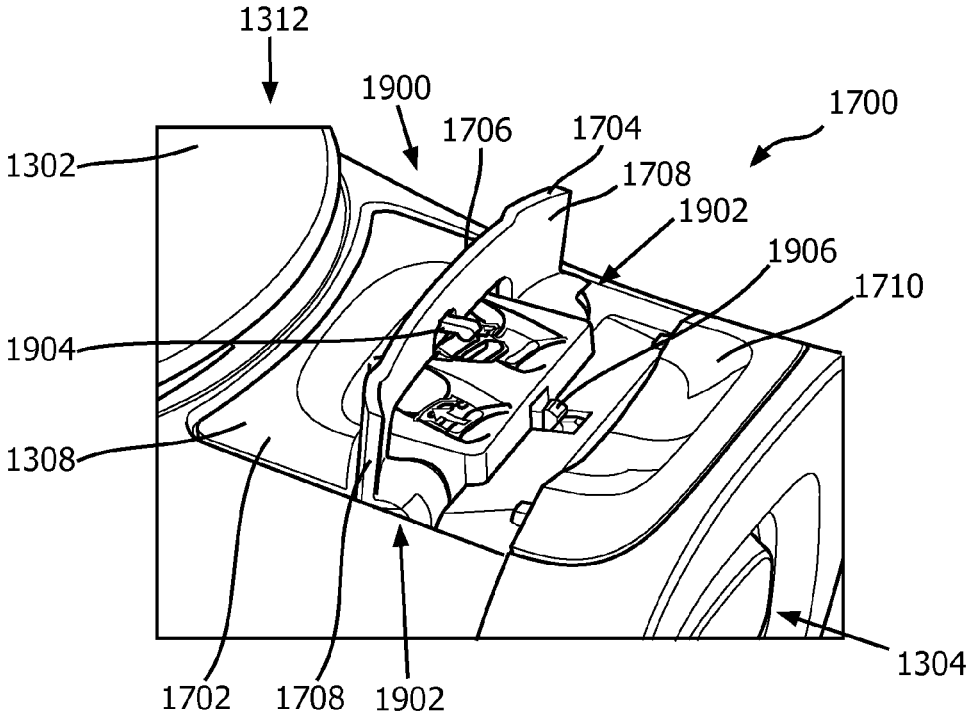
FIG. 19 shows a further view of the scale collector and steam iron of FIG. 17.

FIG. 19 illustrates the lift lever 1704 in the unlocked position 1900. The handle 1706 has been lifted and rotated about two lever mechanisms 1902. The two lever mechanisms 1902 are each connected by a lever arm 1708 to the handle 1706 so that both lever mechanisms 1902 are actuated at exactly the same time. The handle 1706 can be seen as having a first latching nib 1904 and the scale collector 1308 can be seen as having a second latching nib 1906. When the handle 1706 is rotated into the locked position 1720 the two nibs 1904, 1906 interlock and form a snap fit. This holds the handle 1706 in the locked position.

Figure 20:
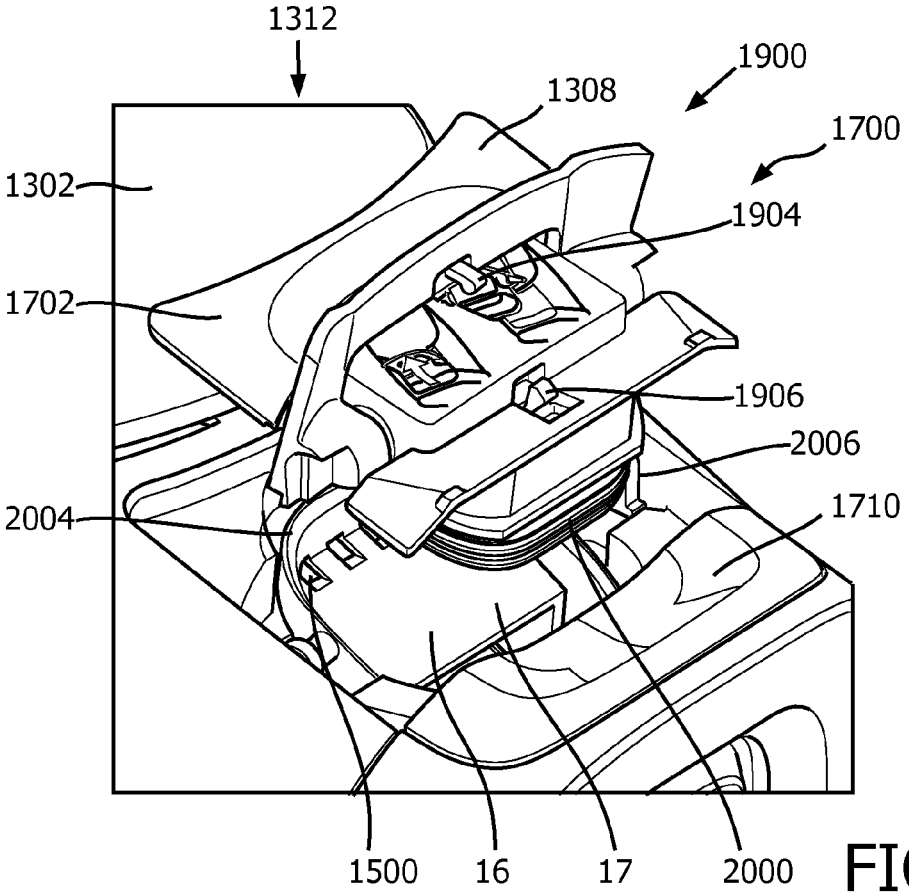
FIG. 20 shows a further view of the scale collector and steam iron of FIG. 17.

FIG. 20 shows the scale collector 1308 as it is being pulled away from the underside 1312 of the steam iron 1700.

The collection compartment 17 is shown to have a scale collector receptacle 2004 which forms a seal with a scale collector sealing surface 2000 of the scale collector. The scale collector sealing surface is shown to have an elastomeric surface 2006 that seals and mates with the scale collector receptacle 2004. When the scale collector 1308 is removed the user can either place the steam iron 1700 upside down and remove the scale collector 1308. The operator can then take the steam iron 1700 to a waste receptacle and overturn the steam iron 1700 to dump the contents of the collection compartment 17 into the waste receptacle. The scale collector 1308 may also be operated differently. The steam iron 1700 can for example be placed into the ironing position 1310 with the scale collector 1308 extending over the edge of a table or ironing board. The operator can then run his or her fingers under the scoop portion 1710 and operate the lift lever 1704 without seeing it. The scoop portion 1710 facilitates tactile operation of the lift lever. The operator can then remove the scale collector 1308 and move the scale collector 1308 to a waste receptacle to dump the scale particles into the waste receptacle.

Figure 21:
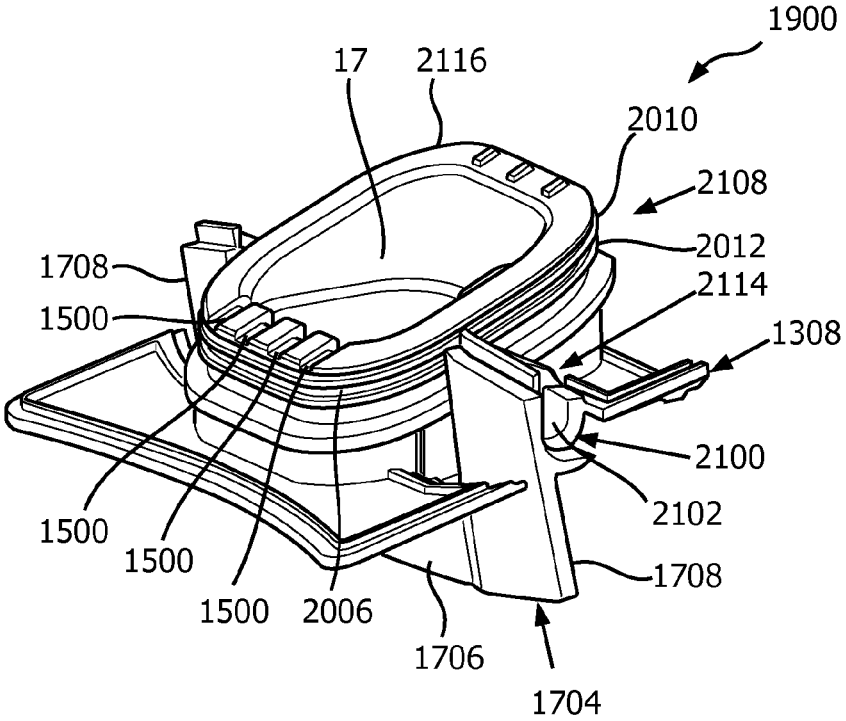
FIG. 21 shows a further view of the scale collector of FIG. 17.
Figure 22:
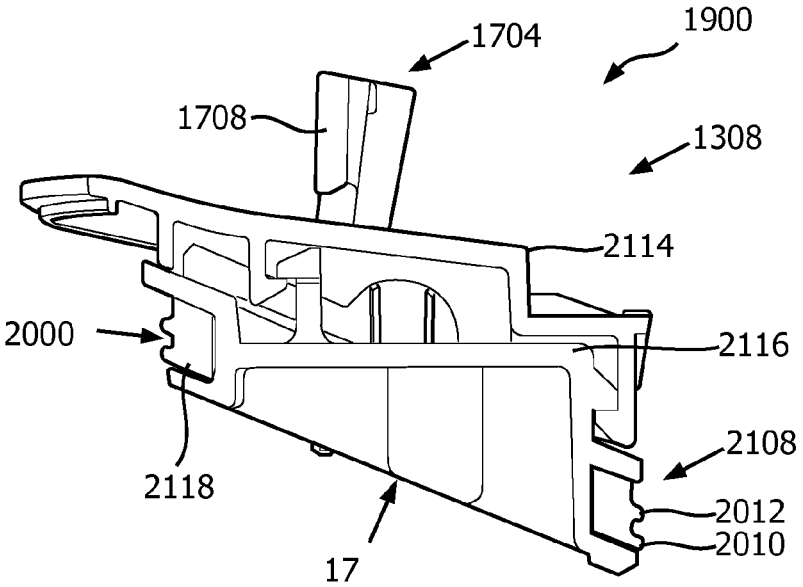
FIG. 22 shows a cross sectional view of the scale collector of FIG. 17.
Figure 23:
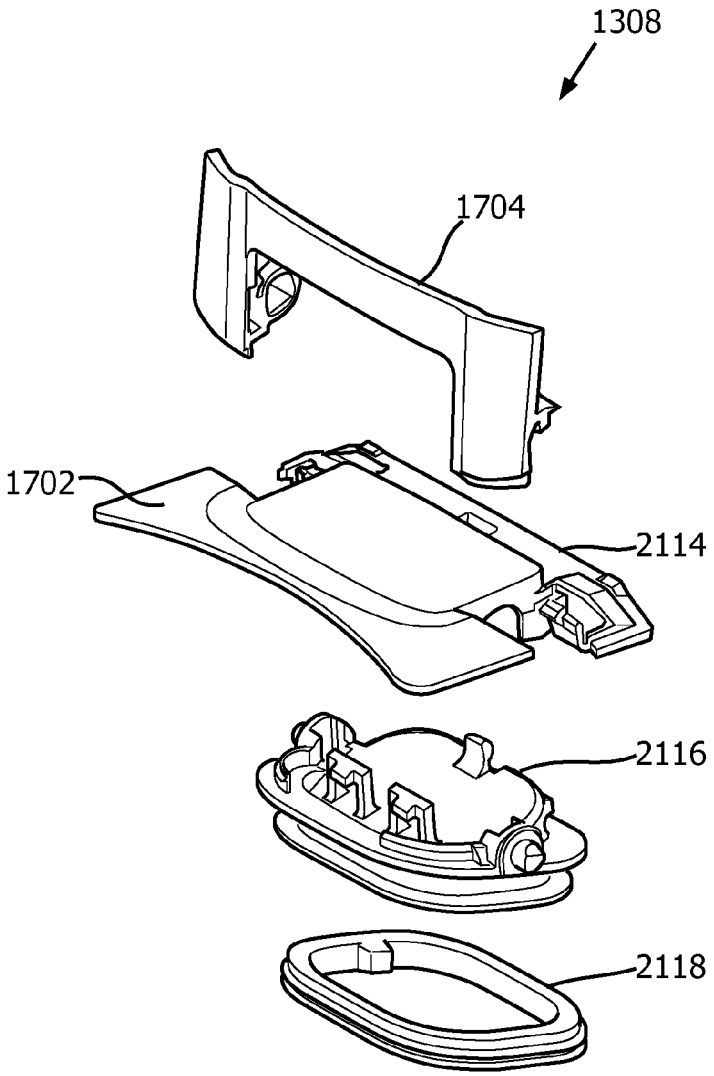
FIG. 23 shows an exploded view of the scale collector of FIG. 17.

FIGS. 21 and 22 show two additional views of the scale collector 1308. FIG. 21 shows an isometric view and FIG. 22 shows a cross-sectional view. In both cases the scale collector 1308 is in the unlocked position 1900. FIG. 23 shows an exploded view of the components used to make the scale collector illustrated in FIGS. 21 and 22. The scale collector comprises the lift lever 1704, a cap 2114, a door 2116 and a seal 2118. FIGS. 21 and 22 show the components of FIG. 23 in an assembled configuration. The seal 2118 is shown as having a double wiper 2108 structure with a leading wiper 2110 and a sealing wiper 2112. As the scale collector sealing surface 2000 is slid into the scale collector receptacle 2004 the leading wiper 2110 will wipe any particulates such as scale away from the sealing wiper 2112. Both the leading wiper 2110 and the sealing wiper 2112 are able to seal the collection compartment 17. However, if the scale collector receptacle 2004 is dirty the double wiper 2108 may help to ensure that the seal is water and/or steam tight. In FIG. 22 it is shown that the cap 2114 is fit together with the door 2116. The door 2116 forms a portion of the collection compartment 17. The door 2116 may also be referred to as the main body. The door 2116 also forms a cup-like structure which is able to hold scale and other debris. In FIG. 21 a portion of the lever mechanism is visible. This includes a hook-like short portion 2100 attached to the end of the lever arms 1708. The hook-like portion 2100 comprises a cylindrically symmetric portion 2102 and an open section 2104.

Figure 24:
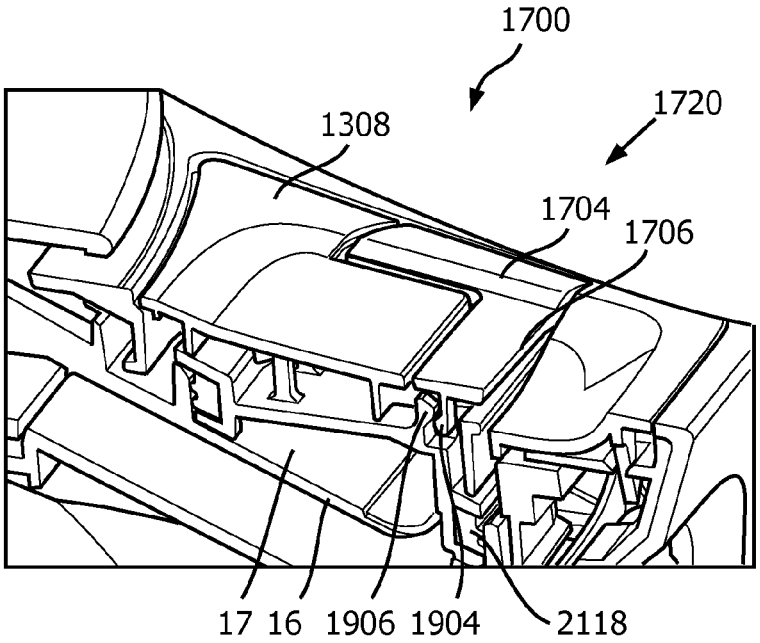
FIG. 24 illustrates a cross sectional view of the scale collector installed into the iron of FIG. 17.
Figure 25:
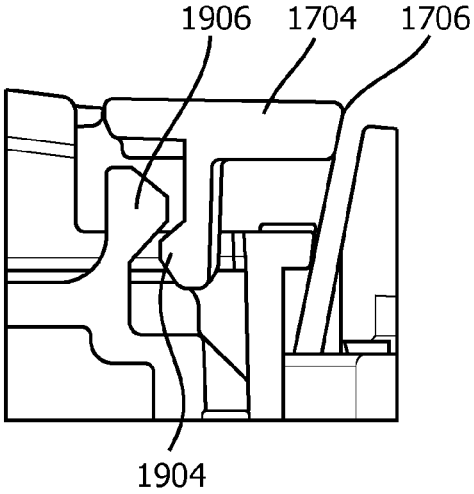
FIG. 25 shows an enlarged view of the cross sectional view of FIG. 24.

FIG. 24 shows an isometric cross-sectional view of the steam iron 1700 that passes through the first latching nib 1904 and the second latching nib 1906. The lift lever 1704 is shown in the locked position 1720. FIG. 25 shows a cross-sectional view 25 along the same plane as has been shown in FIG. 24 that shows the first latching nib 1904 and the second latching nib 1906 in closer detail. In FIGS. 24 and 25 it can be seen that the first latching nib 1904 and the second latching nib 1906 prevent the lift lever 1704 from being opened inadvertently.

Figure 26:
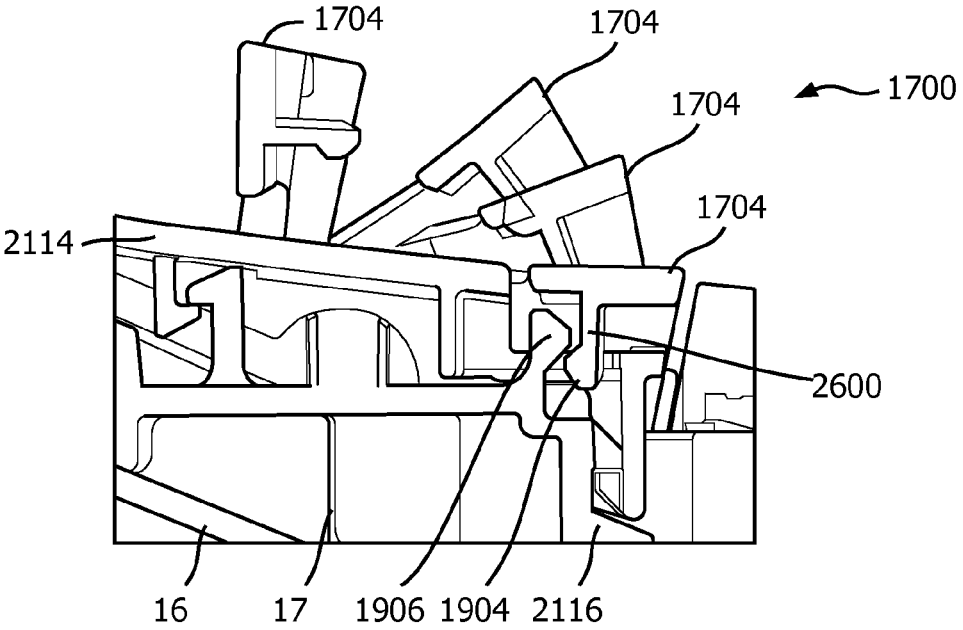
FIG. 26 illustrates the opening of a lever mechanism for the steam iron of FIG. 17.

FIG. 26 shows the cross-sectional view illustrated in FIGS. 24 and 25. In FIG. 26 the lift lever 1704 is shown in four different positions as it is rotated to open it. When closed the first latching nib 1904 needs to be forced past the second latching nib 1906. The first latching nib 1904 is connected to the lift lever 1704 by a flexing arm 2600. As the lift lever 1704 is lifted the flexing arm 2600 flexes and allows the first latching nib 1904 to pass the second latching nib 1906.

Figure 27:
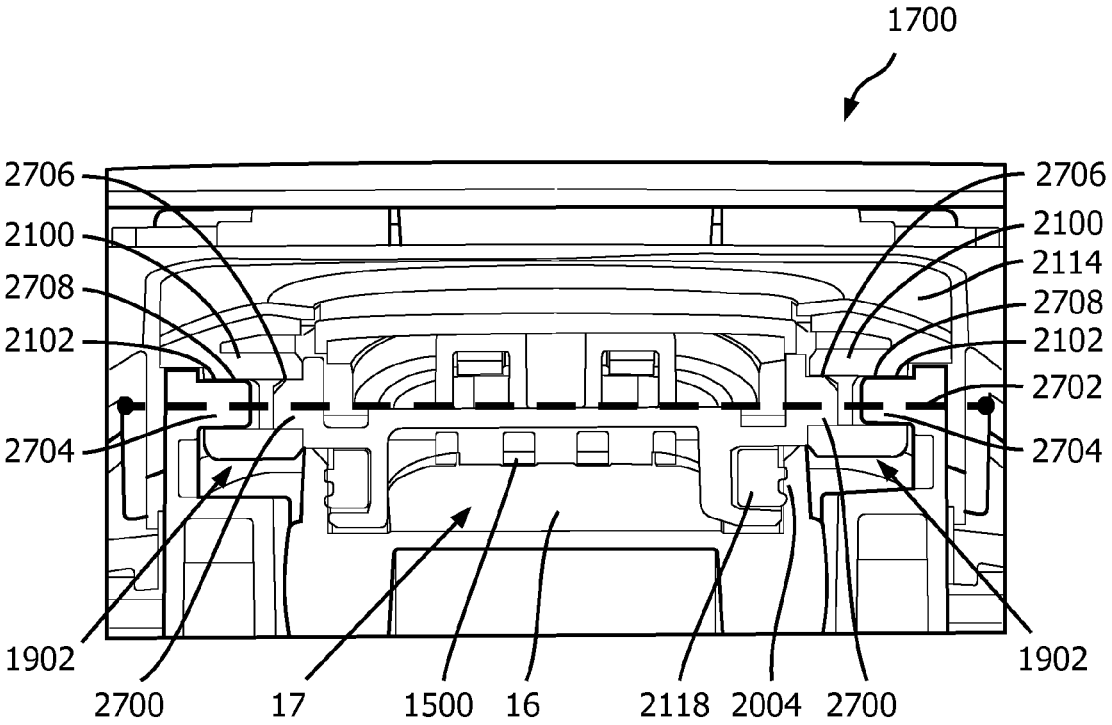
FIG. 27 illustrates a cross sectional view of the lever mechanism of the steam iron of FIG. 17 along a rotational axis.

FIG. 27 is used to partially explain the operation of the lever mechanism 1902. The lever mechanism 1902 is shown as containing two pivots or convex parts 2700 that are configured for rotating around a rotational axis 2702. Each pivot comprises a first concave part 2706 and a second concave part 2708. The First concave part 2706 forms part of a rotational bearing for the pivot 2700.

A cross-sectional view of the hook-shaped portion 2100 is shown as a position as being mated with a cylindrical rod 2704. The hook-shaped portion comprises the second concave part 2708. The second concave part forms the cylindrically symmetric portion 2102. The cylindrical rod 2704 also has rotational symmetry. In this example the axis of rotational symmetry is identical with the rotational axis 2702 when the scale collector 1308 is inserted. The cylindrically symmetric portion 2102 is shown as being able to freely rotate around the cylindrical rod 2704.

Figure 28:
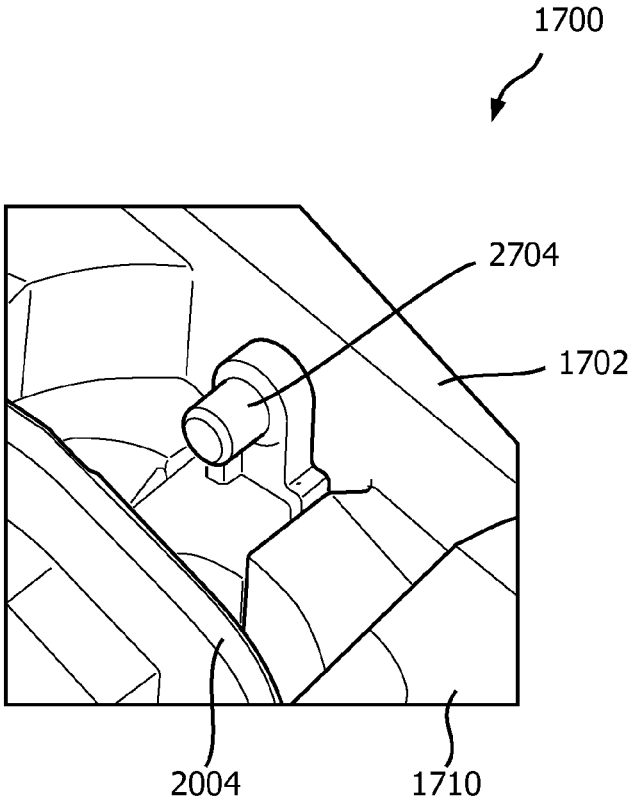
FIG. 28 illustrates a detail view of part of the lever mechanism of the steam iron of FIG. 17.

FIG. 28 shows a view of the steam iron 1700 with the scale collector removed. On either side of the scale collector receptacle 2004 there is a cylindrical rod 2704.

Figure 29:
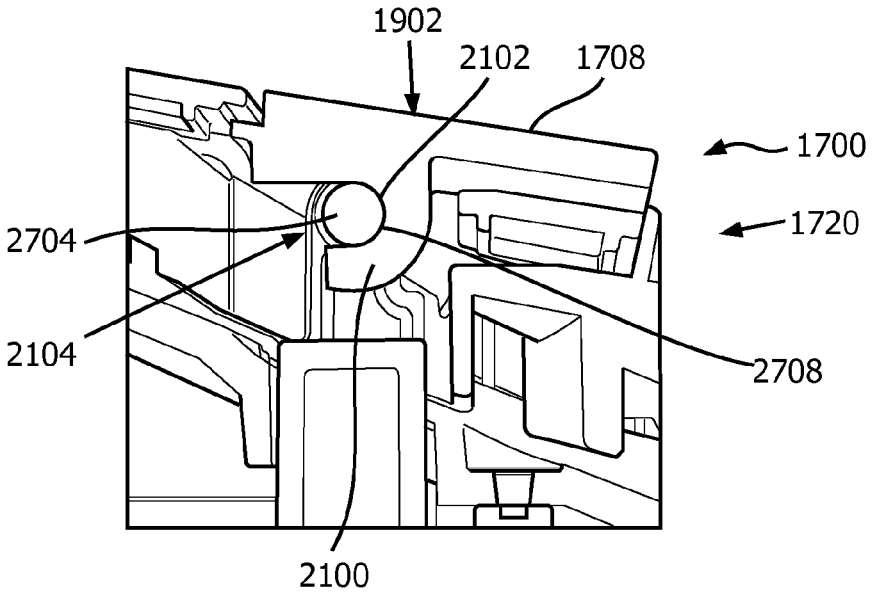
FIG. 29 illustrates the operation of the lever mechanism of the steam iron of FIG. 17.
Figure 30:
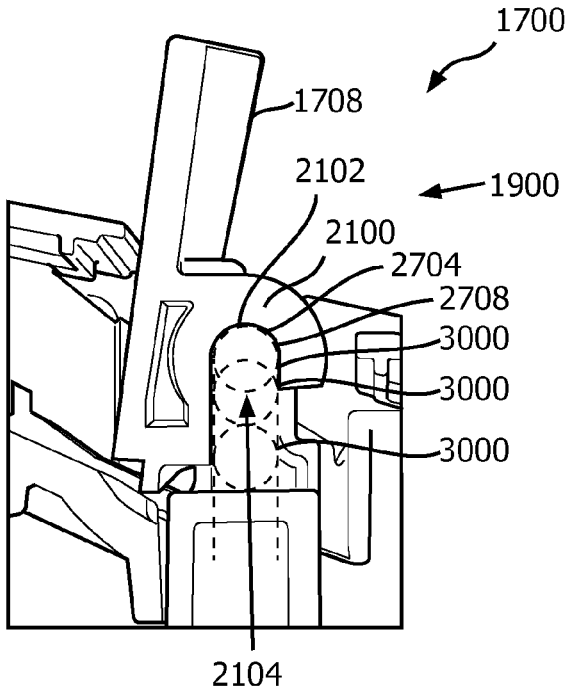
FIG. 30 further illustrates the operation of the lever mechanism of the steam iron of FIG. 17.

FIGS. 29 and 30 illustrate the functioning of the lever mechanism 1902. In FIG. 29 the lever mechanism 1902 is shown in the locked position 1720. In FIG. 30 the lever mechanism 1902 is shown in the unlocked position 1900.

In FIG. 29 it can be seen that the cylindrically symmetric portion 2102 of the hook-shaped portion 2100 is firmly locked and engaged around the cylindrical rod 2704. As the lever arm 1708 is actuated and the pivot rotates the open section 2104 will rotate to a position where the cylindrical rod 2704 can be removed from the cylindrically symmetric portion 2102. In FIG. 30 the cylindrical rod 2704 is no longer restrained by the cylindrical portion 2102. The circles labeled 3000 illustrate motion of the cylindrical rod 2704 through the open section 2104 and away from the hook-shaped portion 2100.

FIGS. 31-34 are used to illustrate a possible modification to the steam iron 1700 illustrated in FIGS. 17-30. In FIGS. 17-30 the lift lever 1704 was locked in the locked position 1720 using the first latching nib 1904 and the second latching nib 1906. In FIGS. 31-34 an alternative to the second latching nib 1906 and the first latching nib 1904 are shown. The additional mechanical components illustrated in FIGS. 31-34 may also be integrated into the examples illustrated in FIGS. 17-30. The two alternatives for locking the lift lever 1704 are not mutually exclusive. Design elements from both may be combined freely together.

Figure 31:
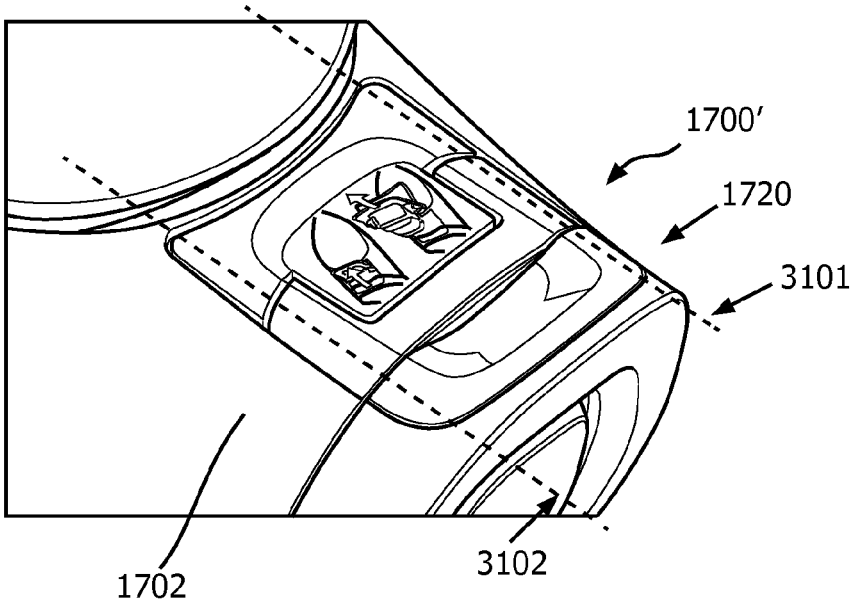
FIG. 31 shows a view of a further example of a steam iron with a scale collector installed.
Figure 32:
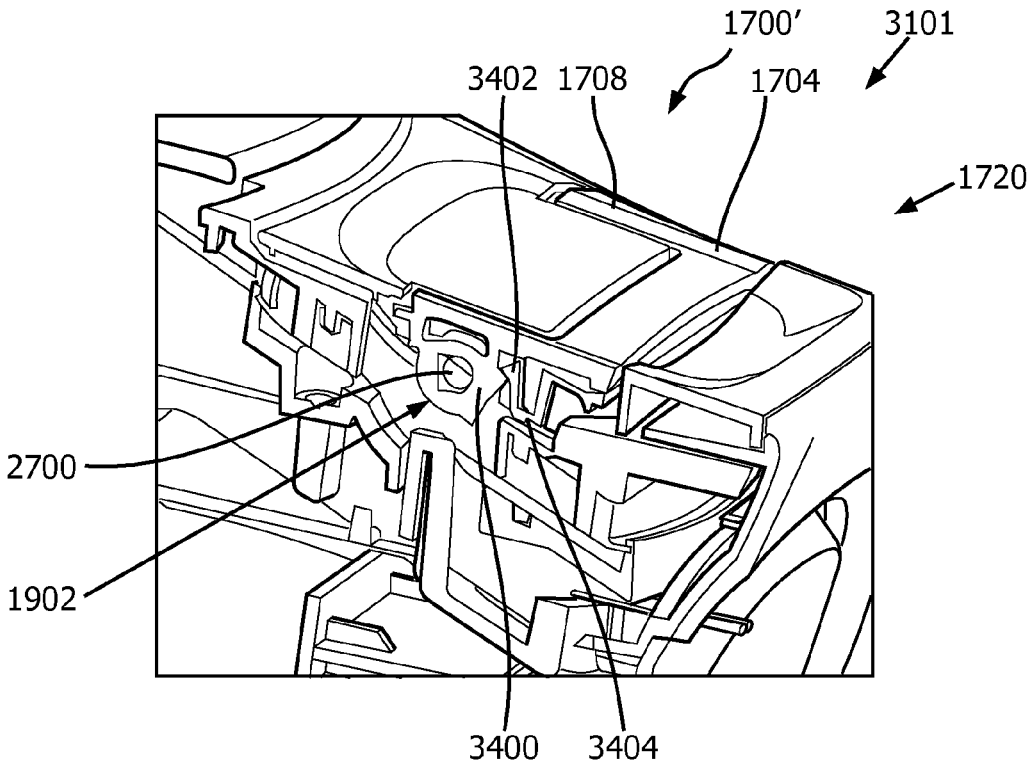
FIG. 32 shows a cross sectional view which illustrates a portion of the lever mechanism of the steam iron of FIG. 31.
Figure 33:
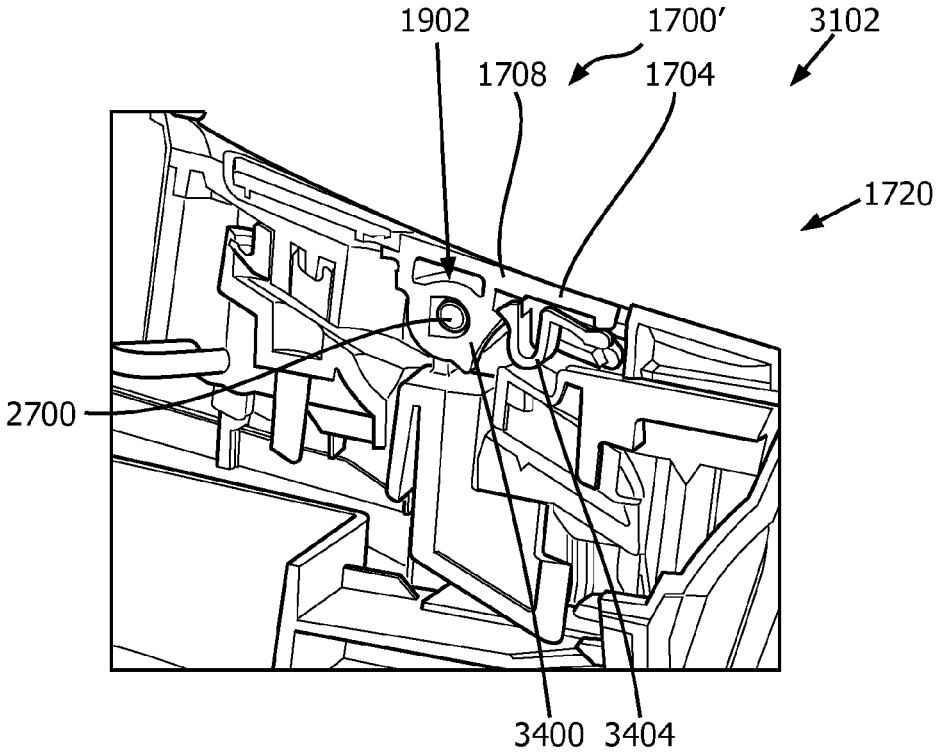
FIG. 33 shows a further cross sectional view which illustrates a portion of the lever mechanism of the steam iron of FIG. 31.

In FIG. 31 an alternative steam iron 1700' is shown. The lever mechanism in the steam iron 1700' is slightly modified. In FIG. 31 the dashed line 3101 indicates the location of a first cross-sectional plane. The dashed line 3102 indicates the location of a second cross-sectional plane. FIG. 32 shows the cross-sectional view 3101. FIG. 33 shows the cross-section along the plane 3102.

Figure 34:
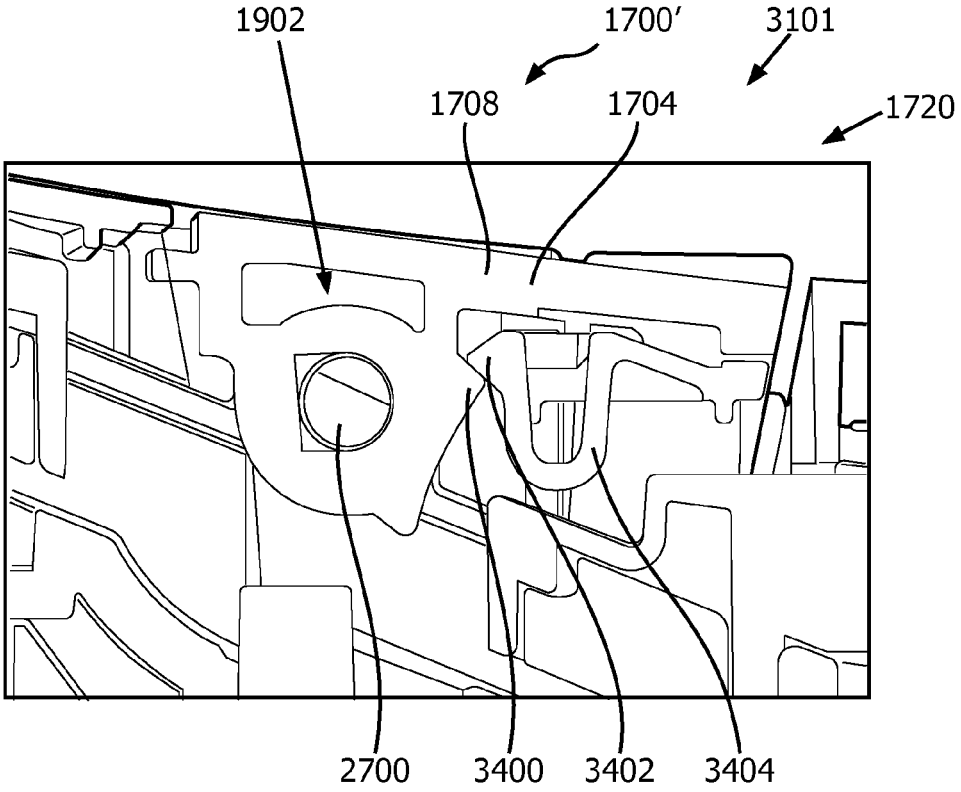
FIG. 34 shows an enlarged view of the cross sectional view of FIG. 32.

FIG. 34 shows a close-up view of the lever mechanism 1902 from FIG. 32. FIGS. 32 and 33 are explained using the close-up view of FIG. 34. In FIG. 34 it can be seen that there is additionally a rotational latch 3400. The rotational latch 3400 matches with a door catch 3402. The door catch 3402 presses against the rotational latch 3400 and prevents the lift lever 704 from being actuated. The rotational latch 3400 may be formed as an extension about the pivot 2700. The door catch 1304 may be attached to a flexible flexing arm 3404. The flexing arm 3404 in this example is shown as having a U-shaped portion which may be deformed. As force is applied to the lift lever 1704 the rotational latch 3400 presses on the door catch 3402 causing the flexing arm 34 to flex which then releases the lift lever 1704 enabling the scale collector to be placed into an unlocked position.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The term "substantially" herein, such as in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein may amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to". The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

LIST OF REFERENCE NUMERALS

10 steam iron
11 scale collector
12 soleplate
12A cover
13 steam chamber
13A opening
14 discharge element
15 duct
16 retaining member
17 collection compartment
18 guide surface
19 passage
20 bottom wall
21 wall
30 steam iron
31 scale collector

32 soleplate
32A cover
33 locking member
34 discharge element
35 duct
36 retaining member
37 collection compartment
38 guide surface
39 passage
39A boundary surface
40 bottom wall
41 wall
42 aperture
45 cavity
51 scale collector
52 soleplate
55 duct
56 bottom wall
57 wall
61 scale collector
62A cover
65 duct
66 bottom wall
67 wall
68 cavity
72 soleplate
72A cover
74 discharge element
76 retaining member
77 collection compartment
78 guide surface
79 passage
79A boundary surface
80 aperture
81 closure
1300 steam iron
1302 ironing surface
1304 heel
1306 upwards direction
1308 scale collector
1310 ironing position
1312 underside
1400 heel rest position
1401 path
1500 drainage duct
1700 steam iron
1700' alternative steam iron
1702 exterior surface
1704 lift lever
1706 handle
1708 lever arm of lever mechanism
1710 scooped portion
1720 locked position
1900 unlocked position
1902 lever mechanism
1904 first latching nib
1906 second latching nib
2000 scale collector sealing surface
2004 scale collector receptacle
2006 elastomeric surface
2100 hook shaped portion
2102 cylindrically symmetric portion
2104 open section
2108 double wiper
2110 leading wiper
2112 sealing wiper
2114 cap
2116 door
2118 seal
2600 flexing arm
2700 pivot
2702 rotational axis
2704 cylindrical rod
2706 first concave part
2708 first concave part
3000 movement
3400 rotational latch
3402 door catch
3404 flexing arm
A-A longitudinal axis
D1 downward direction
D2 upward direction
D3 lateral direction
P1 end portion P1
R rear end
S scale

The invention claimed is:

1. A steam iron comprising:

a soleplate comprising a steam chamber for generating steam, the steam chamber comprising an opening arranged at a rear end of the soleplate;

a discharge element extending from the opening;

a collection compartment formed in the discharge element for collecting calcified deposits formed in the steam chamber, a retaining member arranged in the discharge element, wherein the retaining member extends over a front end portion of the collection compartment to retain the calcified deposits in the collection compartment;

wherein the discharge element comprises an aperture for allowing removal of calcified deposits from the collection compartment and a closure for sealing the aperture.

2. A steam iron according to claim 1, wherein the discharge element comprises a duct extending from the opening and a scale collector having walls defining the collection compartment, the scale collector being removably attachable to the duct.

3. A steam iron according to claim 2, wherein:

the duct comprises the retaining member; or the scale collector comprises the retaining member.

4. A steam iron according to claim 2, wherein the walls of the scale collector include a bottom wall, the retaining member being arranged to overlap the bottom wall when the scale collector is attached to the duct.

5. A steam iron according to claim 2, wherein the scale collector further comprises at least one aperture to drain water in the scale collector towards the opening.

6. A steam iron according to claim 2, further comprising a locking member for locking the scale collector to the duct.

7. A steam iron according to claim 2, wherein the discharge element comprises a cavity, and wherein the scale collector is removably insertable into the cavity.

8. A steam iron according to claim 7, wherein the cavity and the scale collector are arranged to cooperate such that the scale collector is insertable into the cavity in a direction chosen among the set defined by:

a downward direction compared to a plan formed by the soleplate;

an upward direction compared to a plan formed by the soleplate; and, a lateral direction compared to a longitudinal axis of the soleplate, a longitudinal direction compared to a longitudinal axis of the soleplate.

9. A steam iron comprising:

a soleplate comprising a steam chamber for generating steam, the steam chamber comprising an opening arranged at a rear end of the soleplate;

a discharge element extending from the opening;

a collection compartment formed in the discharge element for collecting calcified deposits formed in the steam chamber, a retaining member arranged in the discharge element, wherein the retaining member extends over a front end portion of the collection compartment to retain the calcified deposits in the collection compartment;

wherein the discharge element comprises a duct extending from the opening and a scale collector having walls defining the collection compartment, the scale collector being removably attachable to the duct; and wherein the scale collector scale collector is insertable into the discharge element in an upward direction compared to a plain formed by the soleplate for closing and sealing the collection compartment and then receiving the calcified deposits therein; wherein the scale collector comprises a lift lever which is configured to be actuated between a locked position and an unlocked position; and wherein the lift lever is configured to be rotated to a horizontal direction in the locked position and to a downward direction in the locked position.

10. A steam iron according to claim 9, wherein the lift lever comprises a handle and two lever arms, the handle comprises a first latching nib; the scale collector further comprises a main body, the main body comprises a second latching nib; the first latching nib and the second latching nib are configured to form a snap fit in the locked position correspondingly which keeps the lift lever close to the main body.

11. A steam iron according to claim 9, wherein the lift lever comprises a handle and two lever arms, each lever arm comprises a rotational latch away from the end of the handle; wherein the scale collector further comprises a main body, the main body comprises two door catches sitting at the positions correspond to the positions of the rotational latches; the rotational latches and the door catches are configured to form snap fits in the locked position correspondingly which keeps the lift lever close to the main body.

12. A steam iron according to claim 10, wherein each lever arm comprises a pivoting mechanism away from the end of the handle, each pivoting mechanism comprises an inner side and an outer side; two first concave parts are set at the inner sides respectively for accommodating two convex parts of the main body for making the lift lever rotatable about a rotational axis; two second concave parts are set at the outer sides respectively for accommodating two cylindrical rods fixed inside the discharge element for making the lift lever synchronously rotatable about the rotational axis on the cylindrical rods; wherein each second concave part comprises a hook shaped portion, each hook shaped portion comprises an open section along its rotational circle; wherein each open section is configured to match with the dimension of the cylindrical rod to render the hook shaped portion to be removable therefrom in the unlocked position and to be blocked against the cylindrical rod in the locked position.

13. A steam iron according to claim 1, wherein the retaining member extends over at least 5% of a bottom wall of the collection compartment.

14. A steam iron according to claim 1, wherein the discharge element comprises a passage for carrying the calcified deposits formed in the steam chamber to the collection compartment, wherein the retaining member forms a boundary surface of the passage.

* * * * *